US008418277B2

(12) United States Patent
Okubo et al.

(10) Patent No.: US 8,418,277 B2
(45) Date of Patent: Apr. 16, 2013

(54) FLUSH TOILET

(75) Inventors: Mayu Okubo, Fukuoka (JP); Yoshikazu Ushijima, Fukuoka (JP); Yuichi Sato, Fukuoka (JP); Yoshinobu Kato, Fukuoka (JP); Ryosuke Hayashi, Fukuoka (JP); Ayako Harada, Fukuoka (JP)

(73) Assignee: Toto Ltd., Fukuoka (JP)

( * ) Notice: Subject to any disclaimer, the term of this patent is extended or adjusted under 35 U.S.C. 154(b) by 782 days.

(21) Appl. No.: 12/438,965

(22) PCT Filed: Aug. 29, 2007

(86) PCT No.: PCT/JP2007/066754

§ 371 (c)(1),
(2), (4) Date: Oct. 14, 2009

(87) PCT Pub. No.: WO2008/026633

PCT Pub. Date: Mar. 6, 2008

(65) Prior Publication Data

US 2010/0077544 A1 Apr. 1, 2010

(30) Foreign Application Priority Data

Aug. 31, 2006 (JP) ..... 2006-236088

(51) Int. Cl.
*E03D 11/00* (2006.01)

(52) U.S. Cl.
USPC ..... 4/432; 4/431; 4/332

(58) Field of Classification Search ..... 4/332, 431, 4/432, 425, 346, 354, 344, 334, 362
See application file for complete search history.

(56) References Cited

U.S. PATENT DOCUMENTS

| | | | | |
|---|---|---|---|---|
| 5,109,550 | A * | 5/1992 | Makita et al. | 4/300 |
| 5,204,999 | A * | 4/1993 | Makita et al. | 4/300 |
| 2007/0113331 | A1 * | 5/2007 | Prokopenko et al. | 4/425 |

FOREIGN PATENT DOCUMENTS

| | | | |
|---|---|---|---|
| JP | 3090718 | A | 4/1991 |
| JP | 4194240 | A | 7/1992 |
| JP | 4222730 | A | 8/1992 |
| JP | 2005264469 | A | 9/2005 |

* cited by examiner

OTHER PUBLICATIONS

International Search Report for PCT/JP2007/066754.

*Primary Examiner* — Gregory Huson
*Assistant Examiner* — Erin Deery
(74) *Attorney, Agent, or Firm* — Brooks Kushman P.C.

(57) ABSTRACT

A flush toilet in which an appropriate amount of water is supplied and that can be installed in an area where water pressure is low. The flush toilet is flushed with pressurized flush water and has a flush toilet body having a bowl and a drain trap pipe path; a pressurizing pump for pressurizing flush water to be jetted out; a water storage tank for storing flush water to be pressurized; flush control means for causing rim water discharge to be performed for a predetermined rim water discharge time by water supply pressure of running water and also causing jet water discharge to be made to flush the bowl; flush water replenishing means for replenishing, after the bowl is flushed, flush water to the water storage tank from the running water to thereby return the amount of flush water stored in the water storage tank to a specified level; timing means for measuring a water replenishing time after the flush water replenishing is started until the amount of flush water stored in the water storage tank return to the specified level; and water discharge time regulation means for regulating the rim water discharge time based on the water replenishing time.

16 Claims, 14 Drawing Sheets

FLUSH TOILET

TECHNICAL FIELD

The present invention relates to a flush toilet, and more particularly to a flush toilet flushed with pressurized flush water.

BACKGROUND ART

In recent years, "water main direct-pressure" type flush toilets, in which flush water is supplied directly from a water main, have become more prevalent. In this type of water main direct pressure-type flush toilet, the toilet is generally flushed in a sequence whereby water is spouted from a rim spout at the top of the bowl portion, then from a jet spout at the bottom portion of the bowl portion, then a second time from the rim spout, each for a predetermined time. Because water main direct pressure-type flush toilets do not require a tank for holding all of the flush water for a single flush, they have the advantage that they can be made more compact, but on the other hand have the problem that it may be difficult to supply flush water at an adequate flow rate in localities with low water main pressure, making them difficult to install.

Moreover, the duration of water spouting from the rim spout or the jet spout when flushing the toilet is generally set to be such that the amount of flush water expelled is sufficient even when a water main direct pressure-type flush toilet is installed in an locality with relatively low water main pressure. The problem therefore arises that the amount of flush water expelled is excessive when a water main direct pressure-type flush toilet is installed in a normal water main pressure locality.

U.S. Pat. No. 2,874,207 (Patent Citation 1) describes a flush water supply device for a toilet. In this flush water supply device, a pressure sensor or flow rate sensor is disposed on the water supply path to the rim spout, and a flush water spouting time is set based on values detected by the sensor. In other words, an appropriate volume of flush water can be supplied by using a long spout time in localities with low water main pressure, and a short spout time in localities with high water main pressure.

Patent Citation 1: U.S. Pat. No. 2,874,207

DISCLOSURE OF THE INVENTION

Problems to Be Solved by the Invention

In localities with extremely low water main pressure, however, there is a problem in that even increasing the volume of spouted flush water does not enable sufficient flushing of the toilet. That is, even if low flow rate spout water is spouted over a long duration from a jet spout, in particular, no siphoning effect can be induced in the waste trap pipe, and waste in the bowl portion cannot be adequately discharged.

In the flush water supply device set forth in U.S. Pat. No. 2,874,207, on the other hand, a pressure sensor or flow rate sensor for measuring the pressure of the water main must be provided, leading to the problem of increased cost. It is also difficult to accurately measure water main pressure using a pressure sensor or a flow rate sensor installed in the pathway of water supplied to a rim spout, thus making it difficult to accurately set water spouting times.

Moreover, water main direct pressure-type flush toilets are generally configured so that flush water is spouted via a constant flow valve, so that flush water flow rate will not be excessive even in localities with high water main pressure.

However, flow rates set by the constant flow valve vary greatly from unit to unit, so water spouting times are set such that the volume of flush water spouted is sufficient even when constant flow valves having the lowest flow within this range of variability are used. Therefore the problem arises that flush water volume is excessive when constant flow valves with a large flow rate within the range of variability are used.

The present invention thus has the object of providing a flush toilet capable of supplying an appropriate volume of flush water while being installable in localities having a low water main pressure.

The present invention also has the object of providing a flush toilet capable of constantly supplying an appropriate volume of flush water even when there is great variability between the constant flow valves being used.

Means for Solving the Problems

In order to solve the above-described problems, the present invention is a flush toilet flushed by pressurized flush water, comprising a flush toilet main body furnished with a bowl portion on which a rim water spouting port and a jet water spouting port are formed, and a drain trap pipe; a pressurizing pump for pressurizing flush water spouted from the jet water spouting port; a holding tank for holding flush water to be pressurized by the pressurizing pump; flush control means for causing flush water to be spouted from the rim water spouting port for a predetermined rim spouting time using water main supply pressure, and for flushing the bowl portion by causing a predetermined jet spouting volume of flush water in the holding tank to be spouted from the jet spouting port using the pressurizing pump; flush water replenishment means for supplying flush water from the water main to the holding tank after flushing the bowl portion, thereby restoring the volume of water held in the holding tank to a predetermined pre-flush held water volume; clock means for detecting the water replenishment time starting from the commencement of flush water supply by the flush water replenishment means up until the volume of water held in the holding tank is restored to the predetermined held water volume; and water spouting time adjustment means for adjusting the rim spouting time during which flush water is spouted from the rim water spouting port by the flush control means, based on the water replenishment time detected by the clock means.

In the present invention thus constituted, the flush control means expels flush water from the rim water spouting port over a predetermined rim spouting time using water main supply pressure. Also, the flush control means expels only a predetermined jet water spout volume of flush water held in a holding tank from a jet water spout using a pressurizing pump. After the bowl portion is flushed by these spoutings of water, a flush water replenishment means supplies flush water from the water main to the holding tank and restores the held water volume in the holding tank to a pre-flush predetermined holding volume, while a clock means detects the water replenishment time from the start of supply of flush water until the holding tank held water volume is restored to the predetermined held water volume. A spout water time adjustment means adjusts the rim spouting time for the next toilet flush based on the water replenishment time detected by the clock means.

In the present invention thus constituted, flush water spouted from the jet water spout is pressurized by a pressurizing pump, therefore the toilet can be flushed even in localities where water main supply pressure is low. Because the rim spouting time is adjusted by the water spouting time adjusting means, an appropriate volume of flush water can be supplied.

In the present invention the flush control means is preferably constituted to sequentially execute a first water spouting from the rim water spouting port, a water spouting from the jet water spouting port, and a second water spouting from the rim water spouting port, and the water spouting time adjustment means adjusts the duration of the second rim water spouting from the rim water spouting port.

In the present invention thus constituted, the water spouting time adjustment means adjusts the second rim spouting time from the rim water spout, therefore problems such as breakage of the water seal in the drain trap caused by insufficient water spouting, or overflowing of large volumes of flush water from the bowl portion due to excess rim water spouting can be prevented.

In the present invention, after completion of water spouting from the rim water spouting port, the flush water replenishment means commences supplying water to the holding tank after waiting a predetermined water supply wait time.

In the present invention thus constituted, supply of water to the holding tank commences after a water supply time elapses following completion of rim water spouting, therefore rim water spouting executed prior to supplying the holding tank can be prevented from affecting the water supply pressure when supplying water to the holding tank.

In addition, in the present invention there is preferably a float switch for detecting the water level in the holding tank, and the clock means detects the time up until a predetermined water volume is detected by the float switch.

In the present invention thus constituted, the fact that flush water in the holding tank has reached a predetermined holding water volume is detected by the float switch, therefore the time up until the holding volume in the holding tank is restored to a predetermined holding volume can be accurately detected.

The present invention is a flush toilet flushed by pressurized flush water, comprising a flush toilet main body furnished with a bowl portion on which a rim water spouting port and a jet water spouting port are formed, and a drain trap pipe; a pressurizing pump for pressurizing flush water spouted from the jet water spouting port; a holding tank for holding flush water to be pressurized by the pressurizing pump; flush control means for causing flush water to be spouted from the rim water spouting port using water main supply pressure, and for causing flush water in the holding tank to be spouted from the jet spouting port using the pressurizing pump; flush water replenishment means for supplying flush water from a water main to the holding tank after jet water spouting is completed, thereby restoring the volume of water held in the holding tank to a predetermined pre-flush held water volume; clock means for detecting the water replenishment time starting from the commencement of flush water supply by the flush water replenishment means until the volume of water held in the holding tank is restored to a predetermined measured held water volume which is less than the predetermined held water volume; and water spouting volume adjustment means for adjusting the rim spouting time from the rim water spouting port or the jet water spouting volume spouted from the jet water spouting port, based on the water replenishment time detected by the clock means.

In the present invention thus constituted, the rim spouting time or the jet water spouting volume are adjusted, therefore even if there are individual differences in the constant flow valves used or the like, water waste can be prevented as toilet flushing capability is maintained.

In the present invention the spout water volume adjustment means adjusts the jet water spouting volume by changing the duration of the pressurizing pump operation.

In the present invention thus constituted, appropriate toilet flushing parameters can be set by changing the jet spouting time to change the jet water spouting volume.

In the present invention the spout water volume adjustment means adjusts the jet water spouting volume by varying the rpm of the pressurizing pump.

In the present invention thus constituted, the jet spout water volume is varied by varying the flow rate of the jet spout water to set appropriate flushing of the toilet.

In the present invention, jet water spouting comprises a siphon start-up zone in which siphon action is started up, a siphon continuation zone wherein flow rate is less than in the siphon start-up zone, and started-up siphon action is continued, and a blow zone for pushing out waste within the drain trap pipe after completion of the siphon action, and the flush control means operates the pressurizing pump at an rpm approximately equal to that of the siphon start-up zone.

In the present invention thus constituted, the siphon action started up in the siphon start-up region is continued in the siphon continuation region as flush water is saved, and floating waste and the like are reliably discharged in the blowing zone.

In the present invention the spout water volume adjustment means preferably adjusts the jet water spouting volume by varying the blow zone time.

In the present invention thus constituted, waste can be reliably pushed out from the drain trap pipe even in the flush mode, when generation of a strong siphon action cannot be expected.

In the present invention the flush control means performs rim water spouting over a rim spouting time adjusted based on the water replenishment time detected during the previous toilet flush; in cases where the water replenishment time detected in the most recent toilet flush is longer by a predetermined time than the previous water replenishment time, the water level inside the bowl portion will be raised by additional water spouting after the holding tank is restored to the predetermined held water volume.

In the present invention thus constituted, the flush control means raises the water level in the bowl portion by additional water spouting, therefore breaking of the drain trap pipe seal can be prevented even when the rim water spouting flow rate in the most recent toilet flushing is greatly reduced compared to the rim spout water flow rate in the previous toilet flush.

In the present invention the volume of flush water supplied to the bowl portion by the addition of flush water is determined by the flush control means based on the rim water spouting flow rate and the most recent rim spouting time corresponding to the most recent water replenishment time, so as to seal the drain trap pipe.

In the present invention thus constituted, the additional spout water volume is determined based on the rim water spouting flow rate and the rim spouting time, therefore the drain trap pipe can be reliably water sealed, and the occurrence of water waste due to excessive additional water spouting can be prevented.

Effect of the Invention

The flush toilet of the present invention is capable of supplying an appropriate volume of flush water, and can be installed even in localities with low water main pressure.

Also, the flush toilet of the present invention can supply a constant appropriate volume of flush water even when there is a large variability between individual constant flow valves used.

BEST MODE FOR PRACTICING THE INVENTION

Next, referring to the attached drawings, we will discuss a flush toilet according to a first embodiment of the present invention. FIG. 1 is a right side elevation of a flush toilet according to the present embodiment. FIG. 2 is a top plan view of a flush toilet according to the present embodiment, and FIG. 3 is a left side elevation thereof. FIG. 4 is a perspective view looking down diagonally from the rear right of a flush toilet according the present embodiment; FIG. 5 is a perspective view looking down diagonally from the rear left thereof. In addition, FIG. 6 is a cross section along line VI-VI in FIG. 2. FIG. 7 is a block diagram showing the water supply system for the rim water spouting and the jet water spouting. Note that FIGS. 2 through 6 show a flush toilet according to the present embodiment in which the toilet seat, the cover, the bidet ("Washlet"), and side panels are removed.

As shown in FIG. 1, a flush toilet 1 according to the first embodiment of the present invention has a flush toilet main body 2, a toilet seat 4 disposed on the top surface of the flush toilet main body 2, a cover 6 disposed to cover the toilet seat 4, and a bidet 8 disposed on the rear upper portion of the flush toilet main body 2. A functional portion 10 is disposed at the back of the flush toilet main body 2; this functional portion 10 is covered by side panels 10*a*.

The flush toilet main body 2 is ceramic; on it are formed a bowl portion 12 for receiving waste, a drain trap pipe 14 extending from the bottom portion of the bowl portion 12, a jet water spouting port 16 for jet-spout water, and a rim water spouting port 18 for rim water spouting. The drain trap pipe 14 extends rearward and diagonally upward from the bowl portion 12, then extends downward and connects to a drain pipe D. The jet water spouting port 16 is formed at the bottom of the bowl portion 12, and is configured to expel flush water toward the intake to the drain trap pipe 14. The rim water spouting port 18 is formed on the left side upper rear of the bowl portion 12, and is configured to expel flush water along the edge of the bowl portion 12.

The flush toilet 1 according to the first embodiment of the present invention is directly connected to a water main supplying flush water; flush water is expelled from the rim water spouting port 18 by the water main supply pressure. With respect to jet spout water, the toilet is configured so that flush water held in the holding tank contained in the functional portion 10 is pressurized by the pressurizing pump and expelled in a high flow rate from the jet water spouting port 16.

Next, referring to FIGS. 2 through 7, we discuss the constitution of the functional portion 10.

As shown in FIGS. 2 through 7, built into the functional portion 10 as a rim spout water supply system are a constant flow valve 20, a rim spout water electromagnetic valve 22, a rim spout water vacuum breaker 24, and a rim spout water flapper valve 26. In addition, built into the functional portion 10 as a jet spout water supply system are a tank water supply electromagnetic valve 28, a tank water supply vacuum breaker 30, a holding tank 32, a pressurizing pump 34, a jet water spouting vacuum breaker 36, and a jet water spouting flapper valve 38. Also built into the functional portion 10 are the rim spout water electromagnetic valve 22, the tank water supply electromagnetic valve 28, and a controller 40 (FIG. 7) serving as a flush control means for controlling the pressurizing pump 34.

The constant flow valve 20 is configured so that flush water flowing in from a water intake 20*a* through a stop cock 42*a*, a splitter hardware 42*b*, and a strainer 42*c* (shown in FIG. 7) is constrained down to a predetermined flow rate. In the present embodiment, the constant flow valve 20 is configured so that the flow rate of flush water is limited to 16 liters/minute or less. Flush water passing through the constant flow valve 20 is split into two streams, connected so that one flows to the rim spout water electromagnetic valve 22, and the other to the tank water supply electromagnetic valve 28. Note that in the present embodiment the constant flow valve 20 is disposed on the rear left side of the flush toilet main body 2.

The rim spout water electromagnetic valve 22 is opened and closed by a control signal from a controller 40, thereby expelling or stopping flush water from the rim water spouting port 18. In the present embodiment, the rim spout water electromagnetic valve 22, as with the constant flow valve 20, is disposed to the rear and left of the flush toilet main body 2.

The rim spout water vacuum breaker 24 is disposed midway on the opening 18*a* which guides flush water that has passed through the rim spout water electromagnetic valve 22 to the rim water spouting port 18, and prevents the backward flow of flush water from the rim water spouting port 18. The rim spout water vacuum breaker 24 is disposed approximately 25.4 mm (approximately 1 inch) above the top edge surface of the bowl portion 12, and reliably prevents backflow. Note that in the present embodiment the rim spout water vacuum breaker 24 is disposed at the top of the drain trap pipe 14, at the center rear of the flush toilet main body 2.

The rim spout water flapper valve 26 is disposed on the opening 18*a* on the downstream side of the rim spout water vacuum breaker 24, and prevents backflow from the rim water spouting port 18. In the present embodiment, the series arrangement of the rim spout water vacuum breaker 24 and the rim spout water flapper valve 26 on the rim water spouting port 18 more reliably prevents backflow of the flush water. Note that in the present embodiment, the rim spout water flapper valve 26 is disposed at the top of the jet water spouting flapper valve 38 on the rear left side of the flush toilet main body 2.

The tank water supply electromagnetic valve 28 is opened and closed by a controller 40, and supplies or stops the supply of flush water to the holding tank 32. In the present embodiment, the tank water supply electromagnetic valve 28 is disposed similarly to the constant flow valve 20, at the rear left side of the flush toilet main body 2.

The tank water supply vacuum breaker 30 is disposed midway on the tank water supply path 32*a* guiding flush water which has passed through the tank water supply electromagnetic valve 28 to the holding tank 32, and prevents backflow of flush water from the holding tank 32. The tank water supply vacuum breaker 30 is disposed approximately 25.4 mm (approximately 1 inch) above the top edge surface of the bowl portion 12, and reliably prevents backflow. Note that in the present embodiment, the tank water supply vacuum breaker 30 is disposed above the drain trap pipe 14 at the center of the flush toilet main body 2.

The holding tank 32 is configured to be able to hold flush water to be spouted from the jet water spouting port 16. Note that in the present embodiment the holding tank 32 is disposed so as to extend from the rear right side of the flush toilet main body 2 up to the top of the drain trap pipe 14 at the rear center of the flush toilet main body 2, and has an interior volume of approximately 3 liters. A resin attaching frame 2*a* serving as an attaching portion is affixed at the rear of the flush toilet main body 2; this flush toilet main body 2 is constituted as a separate entity from the flush toilet main body 2, and is formed in approximately a rectangular shape so as to surround the perimeter of the holding tank 32. The holding tank 32 is suspended from the attaching frame 2*a* such that the flange portion at the upper edge thereof engages the attaching frame 2*a*.

Furthermore, in the present embodiment the end of the holding tank 32 is opened in the vicinity of the bottom portion of the holding tank 32; noise during the supply of water is reduced by supplying water to the holding tank 32 in a state whereby the end of the tank water supply path 32*a* is immersed in water. A float switch 32*b* is disposed on the inside of the holding tank 32, and is configured to detect the water level inside the holding tank 32. The float switch 32*b* switches to ON when the water level inside the holding tank 32 reaches a predetermined holding water level; the controller 40 detects this and causes the tank water supply electromagnetic valve 28 to close.

The pressurizing pump 34 is configured to pressurize the flush water held in the holding tank 32, causing it to be expelled from the jet water spouting port 16. In the present embodiment the pressurizing pump 34 is disposed below the holding tank 32, i.e. at the rear right side of the flush toilet main body 2, and on the side of the drain trap pipe 14. As shown in FIG. 4, two downward-extending U-shaped metal plates 32*c* extending rearward are attached to the bottom surface of holding tank 32, and the pressurizing pump 34 is suspended below the holding tank 32 using these metal plates 32*c*.

Built into the pressurizing pump 34 are an impeller 34*a* for pressurizing flush water, and a motor 34*b* (FIG. 7) for driving the impeller 34*a*. In addition, a water removal plug 34*c* (FIG. 7) is connected to the pressurizing pump 34, and leaving this water removal plug 34*c* open enables flush water in the holding tank 32 or the pressurizing pump 34 to be drained for maintenance or the like. A water receiving tray 2*b* is also disposed under the pressurizing pump 34 to receive condensed water droplets or leaked water.

As shown in FIG. 4, the holding tank 32 is connected to the pressurizing pump 34 through an U-shaped pipe 34*d* which extends from the holding tank 32 toward the front of the flush toilet main body 2 and then U-turned to the rear. Moreover, flush water pressurized by the pressurizing pump 34 flows into the jet water spouting vacuum breaker 36 via a crossing pipe 34*e* extending across the flush toilet main body 2 at the rear side of the drain trap pipe 14. Note that in the present embodiment the pressurizing pump 34 pressurizes flush water in the holding tank 32 and expels flush water from the jet water spouting port 16 at a maximum flow rate of approximately 100 liters/minute.

The jet water spouting vacuum breaker 36 is connected on the downstream side to the pressurizing pump 34, and prevents backflow into the holding tank 32 side of water accumulated in the bowl portion 12, while forming a partition between those parts. This makes it possible to set the held water level in the holding tank 32 to be higher than the accumulated water level inside the bowl portion 12. Note that in the present embodiment the jet water spouting vacuum breaker 36 is disposed on the left side of the drain trap pipe 14 at the rear of the flush toilet main body 2.

The jet water spouting flapper valve 38 is connected on the downstream side to the jet water spouting vacuum breaker 36, and prevents backflow of flush water from the jet water spouting port 16. In the present embodiment, the serial placement of the jet water spouting vacuum breaker 36 and the jet water spouting flapper valve 38 enables more reliable prevention of backflow of the flush water. Flush water which has passed through the jet water spouting flapper valve 38 is expelled from the jet water spouting port 16 via a jet-side water supply path 16*a*. Note that in the present embodiment the jet water spouting flapper valve 38 is disposed on the left side of the drain trap pipe 14 at the rear of the flush toilet main body 2. That is, flush water held in the holding tank 32 disposed on the right side of the drain trap pipe 14 and pressurized by the pressurizing pump 34 passes through the crossing pipe 34*e* and reaches the left side located on the opposite side relative to the drain trap pipe 14, passing through the jet water spouting vacuum breaker 36, the jet water spouting flapper valve 38, and the jet-side water supply path 16*a* disposed there, to be expelled from the jet water spouting port 16.

In the present embodiment the jet water spouting flapper valve 38 is disposed under the rim spout water flapper valve 26 at the rear left side of the flush toilet main body 2. Therefore the rim side water supply path 18*a* extending from the rim spout water flapper valve 26 up to the rim water spouting port 18 is also disposed on the same side as the jet-side water supply path 16*a* relative to the drain trap pipe 14.

The controller 40 serving as a flush control means sequentially operates the rim spout water electromagnetic valve 22 and the pressurizing pump 34 under user manipulation of a toilet flushing switch (not shown), causing spouting of water to commence in sequence from the rim water spouting port 18 and the jet water spouting port 16 so as to flush the bowl portion 12. In addition, after flushing has ended the controller 40 opens up the tank water supply electromagnetic valve 28 to replenish flush water to the holding tank 32, and when the float switch 32*b* detects the predetermined holding amount, the tank water supply electromagnetic valve 28 is closed and supply of water is stopped. Therefore the tank water supply electromagnetic valve 28 operates as a flush water replenishment means.

Built into the controller 40 is a clock means 40*a* for measuring the time after commencement of replenishment of flush water to the holding tank 32 until it is detected by the float switch 32*b* to be at the predetermined holding water level. The controller 40 also has built into it a water spouting time adjustment means 40*b* for adjusting the time during which flush water is spouted from the rim water spouting port 18 based on the time measured by the clock means 40*a*. The controller 40 has a temperature sensor 40*c*, which is a temperature detecting means for measuring the temperature in the room where the flush toilet 1 is installed, a freeze prevention control means 40*d* for implementing a freeze prevention operation if there is a risk that flush water in the flush toilet 1 will freeze, and a timer 40*e* for counting time intervals for freeze prevention operation. Specifically, the controller 40 comprises a CPU, a memory, and a program to operate those.

Next, referring to FIG. 8, we discuss the constitution of the jet water spouting vacuum breaker 36. FIG. 8 is a cross section of the jet water spouting vacuum breaker 36. As shown in FIG. 8, the jet water spouting vacuum breaker 36 has a valve main body 44 on which are formed a water intake 44*a* and a water outlet 44*b*, a vacuum breaker top 46 disposed within this valve main body 44 so as to be vertically movable, and a vacuum breaker main body 48 attached to the valve main body 44, on which is formed an atmosphere opening port 48*a*.

The valve main body 44 water intake 44*a* is open toward the vertical direction, and is connected to communicate with the crossing pipe 34*e*. The water outlet 44*b* is open toward the horizontal direction, and is connected to the intake of the jet water spouting flapper valve 38.

The vacuum breaker top 46 has an approximately disk-shaped vacuum body portion 46*a*, and a shaft portion 46*b* extending vertically from the center of this vacuum body portion 46*a*. A bottom surface seal material 46 for closing the water intake 44*a* is further attached to the bottom surface of the vacuum body portion 46*a*, and a top surface seal material 46 for closing the atmosphere opening port 48*a* is attached to the top surface of the vacuum body portion 46*a*.

The vacuum breaker main body 48 is an approximately disk-shaped member; the atmosphere opening port 48*a* is formed on the bottom end thereof, and the lower portion thereof is inserted into the valve main body 44. A guide portion 48*b* for slidably accepting the vacuum breaker top 46 shaft portion 46*b* is provided on the top of the center axis line of the vacuum breaker main body 48. Acceptance of the shaft portion 46*b* into the guide portion 48*b* results in the vacuum breaker top 46 being slidably supported between a lower position at which the bottom surface seal material 46 closes the water intake 44*a*, and an upper position at which the top surface seal material 46 doses the atmosphere opening port 48*a*.

During use, when flush water from the water intake 44*a* flows in from the water intake 44*a*, the fluid momentum thereof causes the vacuum breaker top 46 to move to the upper position, and the atmosphere opening port 48*a* is closed. Flush water which has flowed in from the water intake 44*a* is thereby expelled from the water outlet 44*b*. Moreover, when the inflow of flush water from the water intake 44*a* is stopped, the vacuum breaker top 46 is moved by gravity to the lower position, and the water intake 44*a* is closed. By this means, backflow of flush water from the water outlet 44*b* to the water intake 44*a* is prevented. Since the water outlet 44*b* communicates with the atmosphere opening port 48*a*, the water intake 44*a* and the water outlet 44*b* are separated, and the holding tank 32 in communication with the water intake 44*a* ceases to move in tandem with the water level of the bowl portion 12 in communication with the water outlet 44*b*.

Above we have discussed the structure of the jet water spouting vacuum breaker 36, but the rim spout water vacuum breaker 24 and the tank water supply vacuum breaker 30 also have similar structures.

Next, referring to FIGS. 9 through 13, we explain the procedure for removing the holding tank 32 and the pressurizing pump 34 during maintenance. FIGS. 9 through 13 are perspective views and side elevations showing a procedure for removing the holding tank 32 and the pressurizing pump 34 as a single unit from the flush toilet main body 2 in the upward direction.

First, as is shown in FIG. 9, when removing the holding tank 32 and the pressurizing pump 34 the toilet seat 4, the cover 6, and the local flushing device 8 attached at the top of the flush toilet main body 2 are removed to expose the upper portion of the functional portion 10. Next, as shown in FIG. 10, the side panels 10*a* attached to both sides of the functional portion 10 are removed. As shown in FIG. 11, the rim spout water vacuum breaker 24, the tank water supply vacuum breaker 30, and the jet water spouting vacuum breaker 36 disposed at the upper part of the holding tank 32, along with pipes attached thereto, are next removed. Screws affixing the holding tank 32 flange portion to the attaching frame 2*a* are then removed.

Next, as shown in FIG. 12, U-pipe 34*d* connecting portions 50*a* and 50*b* connecting the holding tank 32 and the pressurizing pump 34 are removed by inserting one's hand from the side surface of the functional portion 10, which has been exposed by first removing the side panels 10*a*. Similarly, a connecting portion 50*c* connecting the pressurizing pump 34 and the crossing pipe 34*e* is removed, as are electrical connectors (not shown) connected to the pressurizing pump 34. As shown in FIG. 13, the holding tank 32, which is suspended from the attaching frame 2*a*, is removed by pulling it upward from the flush toilet main body 2. By this means the pressurizing pump 34, which is suspended from the holding tank 32 by the metal plates 32*c*, is removed as an integral piece.

Next, referring to FIGS. 14 through 16, we discuss the operation of flush toilet 1 according to a first embodiment of the present invention. FIG. 14 is a graph showing the timing at which the pressurizing pump 34 operates. FIG. 15 is a flow chart showing the flushing operations in the flush toilet 1.

First, in the standby state (Step S0 in FIG. 15), operation of a toilet flush switch (not shown) causes an advance to Step S1, and the first rim water spouting is commenced. That is, when a user operates the toilet flushing switch (not shown) at time t0 in FIG. 14, the controller 40 sends a signal to the rim spout water electromagnetic valve 22 to open, and flush water is expelled from the rim water spouting port 18 by water main pressure. When the rim spout water electromagnetic valve 22 is opened, flush water supplied from the water main flows into the constant flow valve 20 via the stop cock 42*a*, the splitter hardware 42*b*, and the strainer 42*c*. In the constant flow valve 20, when the water main supply pressure is high, the flow rate of the flush water passing through is limited to a predetermined flow rate; when supply pressure is low, the flush water flows as is without restriction. Flush water which has passed through the constant flow valve 20 then further passes through the rim spout water electromagnetic valve 22 disposed at the rear left side of the flush toilet main body 2, reaching the rim spout water vacuum breaker 24 disposed above the drain trap pipe 14 at the rear center of the flush toilet main body 2.

After flush water which has passed through the rim spout water vacuum breaker 24 flows into the rim spout water flapper valve 26 disposed at the rear left side of the flush toilet main body 2, it then flows toward the front of the flush toilet main body 2 and passes through the rim side water supply path 18*a* to be expelled from the rim water spouting port 18 opened on the rear left side of the upper portion of the bowl portion 12. Flush water expelled from the rim water spouting port 18 flows downward as it swirls around the inside of the bowl portion 12, such that the inside wall surface of the bowl portion 12 is cleaned.

Following the elapse of a predetermined time period, the system advances to Step S2, and jet water spouting is commenced. That is, at time t1 in FIG. 14 the controller 40 sends a signal to the pressurizing pump 34 to turn ON. When the pressurizing pump 34 is turned ON, the flush water held in the holding tank 32 is pressurized. After flush water pressurized by the pressurizing pump 34 disposed on the rear right side of the flush toilet main body 2 flows through the crossing pipe 34*e* to the opposite side of the drain trap pipe 14, it reaches the jet water spouting vacuum breaker 36 disposed on the right side of the drain trap pipe 14. Flush water which has passed through the jet water spouting vacuum breaker 36 flows into the jet water spouting flapper valve 38 disposed beneath the rim spout water flapper valve 26 on the rear left side of the flush toilet main body 2. Flush water which has passed through the jet water spouting flapper valve 38 flows toward the front of the flush toilet main body 2, passes through the jet-side water supply path 16*a* on the bottom side of the rim side water supply path 18*a*, and is expelled from the jet water spouting port 16 opened on the bottom portion of the bowl portion 12.

Flush water expelled from the jet water spouting port 16 flows into the drain trap pipe 14, filling the drain trap pipe 14 and generating a siphon effect. Accumulated water and waste in the bowl portion 12 is suctioned into the drain trap pipe 14 and expelled from the drain pipe D by this siphon effect. Note that in the present embodiment the flush water pressurized by the pressurizing pump 34 is expelled from the jet water spouting port 16 at a large flow rate of approximately 100 liters/ minute, so the siphon effect in the drain trap pipe 14 is generated very rapidly, and accumulated water and waste in the bowl portion 12 is discharged quickly. The maximum flush water flow rate expelled from the jet water spouting port 16 is preferably between approximately 75 and 110 liters/minute.

After the elapse of a predetermined time period, in time t2 in FIG. 14 the controller 40 sends a signal to the rim spout water electromagnetic valve 22 to close, and water spouting from the rim water spouting port 18 is stopped. That is, in times t1-t2, water spouting from the jet water spouting port 16 and water spouting from the rim water spouting port 18 are carried out simultaneously. By starting the pressurizing pump 34 during spouting of water from the rim water spouting port 18 to start the spouting of water from the jet water spouting port 16, the start-up sound of the pressurizing pump 34 is masked by the sound of rim water spouting, and does not stand out.

The start-up of the pressurizing pump 34 and the spouting of flush water in the holding tank 32 from the jet water spouting port 16 causes the water level in the holding tank 32 to drop. The float switch 32*b* disposed inside the holding tank 32 turns OFF at time t3 in FIG. 14, such that the drop in water level is detected.

Next, at time t4 in FIG. 14, the controller 40 sends a signal to the pressurizing pump 34 causing the rpm of the motor 34 built into the pressurizing pump 34 to the gradually decrease. As a result, the water spouting flow rate from the jet water spouting port 16 also gradually decreases in essentially a linear manner with respect to time.

The system next proceeds to Step S3 in FIG. 15, whereby the second rim spouting is commenced. That is, at time t5 in FIG. 14 the controller 40 sends a signal to the rim spout water electromagnetic valve 22 to open, and the second spouting from the rim water spouting port 18 is commenced. This causes the water spouted from the rim water spouting port 18 to overlap the water spouted from the jet water spouting port 16, which is gradually diminishing in spout flow rate. Here, while water is being spouted from the jet water spouting port 16 at maximum flow rate, the flow rate of flush water discharged from the drain trap pipe 14 is essentially equal to the flow rate of flush water flowing in from the jet water spouting port 16, so the siphon effect in the drain trap pipe 14 is continued without interruption. Moreover, gradually decreasing the volume of water spouted from the jet water spouting port 16 down from the maximum flow rate prevents the occurrence of a large siphon cutoff sound caused by a sudden halting of the siphon effect. Also, by overlapping the water spouted from the rim water spouting port 18, the reduction in spouted water flow rate is further ameliorated, and the sound occurring when the siphon effect stops is further reduced.

Next, the rpm of the gradually reduced motor 34 reaches zero at time t6 in FIG. 14, and the pressurizing pump 34 stops. Operation of the pressurizing pump 34 between times t1-t6 causes a predetermined volume of jet spouted water to be expelled from the jet water spouting port 16, and the volume of water held in the holding tank 32 becomes approximately zero. Spouting of water from the jet water spouting port 16 is stopped as a result of the pressurizing pump 34 being stopped. This causes the jet water spouting vacuum breaker 36 vacuum breaker top 46 (FIG. 8) to close the water intake 44*a*, so that accumulated water in the bowl portion 12 is separated from the flush water in the holding tank 32. In the present embodiment, the controller 40 controls the pressurizing pump 34 to cause water to be spouted for approximately 2 seconds at the maximum flow rate from the jet water spouting port 16, then to gradually reduce the spout water flow rate so that the spout water flow rate goes to zero in approximately 1 second. Control is preferably effected so that after spouting at the maximum flow rate for 1.5 to 2.0 seconds, the spout water flow rate goes to zero in 1.5 to 2.0 seconds.

The level of accumulated water in the bowl portion 12 rises as a result of the second water spouting from the rim water spouting port 18, reaching a predetermined overflow level in the bowl portion 12. At time t7 in FIG. 14 the controller 40 sends a signal to the rim spout water electromagnetic valve 22 to close, thereby stopping the second spouting of water from the rim water spouting port 18. Note that for simplicity the flow chart shown in FIG. 15 shows jet water spouting commencing after the first rim spouting, followed by execution of the second rim spouting, but in the present embodiment, as shown in more detail in FIG. 14, there is a period during which each of the spouted waters overlaps.

The system next advances to Step S4, where replenishment of flush water to the holding tank 32 is commenced, and the clock means 40*a* built into the controller 40 begins counting water replenishment time until the holding tank 32 returns to a predetermined holding volume. That is, after spouting of water from the rim water spouting port 18 is stopped, and a predetermined water supply wait time has elapsed, the controller 40 sends a signal at a time t8 to the tank water supply electromagnetic valve 28 to open. This is to avoid the effects of rim water spouting on the water supply pressure to the holding tank 32. That is, because of the time delay in the operation of the rim spout water electromagnetic valve 22, the pressure of water supplied to the holding tank 32 drops in the state in which the rim spout water electromagnetic valve 22 is completely closed. Supply of water to the holding tank 32 is therefore commenced after a predetermined water supply wait time has elapsed and the rim spout water electromagnetic valve 22 has completely closed. In the present embodiment 0.5 seconds is used as the water supply wait time t8-t7. This water supply wait time could be eliminated, but if used a setting of 1 second or less is preferred.

Once the tank water supply electromagnetic valve 28 is released, flush water which has flowed in from the water intake 20*a* passes through the tank water supply electromagnetic valve 28 disposed on the rear left side of the flush toilet main body 2 and through the tank water supply path 32*a*, then flows into the tank water supply vacuum breaker 30 above the drain trap pipe 14 at the rear center of the flush toilet main body 2. Flush water which has passed through the tank water supply vacuum breaker 30 flows on the right side of the drain trap pipe 14, then flows into the holding tank 32 from the end of the tank water supply path 32*a* extending up to the vicinity of the bottom portion of the holding tank 32. The end of the tank water supply path 32*a* in which the flush water flows is in an essentially submerged state within the holding tank 32, thus reducing the noise occurring when flush water flows into the holding tank 32.

Next, in Step S6 in FIG. 15, a determination is made as to whether the float switch 30, which had been in the OFF state, is now ON; if it is in the OFF state, the Step S6 process is repeated. When flush water flows into the holding tank 32, and the water level in the holding tank 32 reaches a predetermined holding volume, the float switch 32*b* goes ON (time t9 in FIG. 14). When float switch 32*b* goes ON, the system advances to Step S7, and the tank water supply electromagnetic valve 28 is closed. In other words, the controller 40 sends a signal to the tank water supply electromagnetic valve 28 to close. Next, advancing to Step S8, the clock means 40*a* ends the measurement of water replenishment time.

Next, in Step S9, the second rim spouting time for the next toilet flush (t5-t7 in FIG. 14) is determined by the water spouting time adjustment means 40*b* built into the controller 40. First, the water spouting time adjustment means 40*b* calculates a moving average value for the past 50 water replenishment times calculated by the clock means 40*a*. In other words, it calculates an average value Tav for the most recent 50 iterations of the water replenishment time Te-Ts, which is the elapsed time from time Ts (t8 in FIG. 14) when the tank water supply electromagnetic valve 28 was released up until the time it was closed Te (t9 in FIG. 14). When this average value Tav is less than 5 seconds, the water spouting time adjustment means 40*b* judges that the flush toilet 1 is installed in a locality where the supply water pressure is the normal 0.07 MPa. When the average value Tav is greater than 5 seconds and less than 7 seconds, the water spouting time adjustment means 40*b* judges that the flush toilet 1 is installed in a locality with low supply water pressure. When the average value Tav is greater than 7 seconds, the water spouting time adjustment means 40*b* judges that the flush toilet 1 is installed in a locality with extremely low supply water pressure of less than 0.03 Mpa.

Furthermore, when the supply water pressure is high, the water spouting time adjustment means 40*b* sets the second rim spouting time to be short in the next toilet flushing, and when the supply water pressure is low, it sets the second rim spouting time to be long. In other words, when the water spouting time adjustment means 40*b* judges that the flush toilet 1 is installed in a normal locality, it sets the second rim spouting time for the next toilet flushing to be 3 seconds. When the water spouting time adjustment means 40*b* judges that the toilet is in a low-pressure locality, it sets the second rim spouting time to 4 seconds, and when it judges that it is an extremely low pressure locality, it sets that time to 5.5 seconds. Thus excessive flows from the bowl portion 12 through the drain trap pipe 14 due to spouting of water for long periods in localities where water supply pressure is high, or breaking of the drain trap pipe 14 water seal due to insufficient flush water because rim spouting does not continue for a sufficient length of time in localities with low water main supply pressure, can be prevented.

As described above, the water spouting time adjustment means 40*b* sets the second rim spouting time for the next toilet flushing based on the average time Tav of the most recent 50 water replenishments, but when the number of past toilet flushes is less than 50 it calculates an average value Tav by averaging all past water replenishment times. In addition, when a flush toilet 1 is flushed for the first time after being installed, the second rim spouting time is set at 2.5 seconds so that there will not be an insufficiency of flush water.

In Step S9, once the second rim spouting time is determined at the time of the next toilet flushing, the system returns to the Step S0 standby state.

Next, referring to FIG. 16, we discuss the operation of the freeze prevention control means 40*d* built into the controller 40. FIG. 16 is a flowchart showing the freeze prevention operation in the flush toilet 1.

First, in the flush toilet 1, Step S101 is executed following Step S100, which is a standby state in which no toilet flushing is carried out. In Step S101, a judgment is made as to whether the temperature inside the toilet room measured by the controller 40 temperature sensor 40*c* is below a predetermined freeze prevention operating temperature. When the temperature inside the toilet room is higher than the freeze prevention operating temperature, the freeze prevention operation after Step S102 is not executed, the system returns to Step S100 and repeats the Step S101 process. The freeze prevention operating temperature in the present embodiment is set at 5° C. The freeze prevention operation is also executed when a user sets the system to perform the freeze prevention operation using an operating switch (not shown) provided on the flush toilet 1. In the present embodiment, the freeze prevention operation is set by a special operation of an operating switch (not shown). In other words, the freeze prevention operation is set by operating multiple switches (not shown) originally intended for executing other functions, or by holding down a switch for a predetermined period of time.

Next, when the temperature in the toilet room falls below the freeze prevention operating temperature, the freeze prevention control means 40*d* releases the rim spout water electromagnetic valve 22 in Step S102. Release of the rim spout water electromagnetic valve 22 causes a supply of flush water from the water main to pass through the stopcock 42*a*, the splitter hardware 42*b*, the strainer 42*c*, the constant flow valve 20, the rim spout water electromagnetic valve 22, the rim spout water vacuum breaker 24, the rim spout water flapper valve 26, and the rim side water supply path 18*a* due to the supply pressure of the water main, so that water is spouted into the bowl portion 12 from the rim water spouting port 18 at a flow rate of approximately 15 liters/minute. Flush water which had accumulated in the water supply system is thus moved, and freezing there is prevented. After approximately 1 second has elapsed, Step S103 is executed, and the freeze prevention control means 40*d* closes the rim spout water electromagnetic valve 22.

Next, in Step S104, the freeze prevention control means 40*d* causes the pressurizing pump 34 to turn at a slow speed. When the pressurizing pump 34 is turned, flush water in the holding tank 32 is spouted from the jet water spouting 16 via the pressurizing pump 34, the jet water spouting vacuum breaker 36, the jet water spouting flapper valve 38, and the jet-side water supply path 16*a*. Flush water which had accumulated in the water supply system is thus moved, and freezing there is prevented. After the elapse of approximately 20 seconds, which is the predetermined freeze prevention pump operating time, Step S105 is executed and the freeze prevention control means 40*d* stops the pressurizing pump 34. Note that in the present embodiment the pressurizing pump 34 is operated at an rpm such that flush water is spouted from the jet water spouting port 16 at a flow rate of approximately 0.7 liters per minute. By spout water from the jet water spouting port 16 at this type of low flow rate, the above flush water which had accumulated in the water supply system can be moved without generating a siphon effect in the drain trap pipe 14. By this means, noise generated by the siphon effect can be prevented and waste of flush water can be minimized.

Next, in Step S106, a judgment is made of the state of the float switch 32*b*. The volume of water held in the holding tank 32 is reduced by operating the pressurizing pump 34 for approximately 20 seconds. The float switch 32*b* provided inside the holding tank 32 goes to OFF when the held water volume is below a predetermined replenishment holding volume. When the float switch 32*b* is turned OFF, the system proceeds to Step S107; in Step S107 the freeze prevention control means 40*d* releases the tank water supply electromagnetic valve 28 and replenishes flush water into the holding tank 32. That is, the holding tank 32 and the tank water supply electromagnetic valve 28 function as a held water maintenance means. By releasing the tank water supply electromagnetic valve 28, flush water supplied from the water main is supplied into the holding tank 32, passing through the stopcock 42*a*, the splitter hardware 42*b*, the strainer 42*c*, the constant flow valve 20, the tank water supply electromagnetic valve 28, and the tank water supply vacuum breaker 30. Water which had been accumulating in the water supply system is thus moved and the freezing thereof is prevented.

When the held water amount in the holding tank 32 increases to a predetermined held water volume and rises to a predetermined water level, the fact that the float switch 32*b* has turned ON is detected in Step S106. When it is judged that the float switch 32*b* has turned ON, the system proceeds to Step S108, wherein the freeze prevention control means 40*d* closes the tank water supply electromagnetic valve 28. Next, in Step S109, the timer 40*e* built into the controller 40 commences counting down the time until the freeze prevention operation is next executed. In Step S110, after the timer 40*e* commences counting, a judgment is made as to whether the predetermined time interval for freeze prevention operation has elapsed. In the present embodiment the time interval for the freeze prevention operation is set at 10 minutes.

If the 10 minute freeze prevention operation interval has not elapsed, processing in Step S110 is repeatedly executed; after 10 minutes have elapsed the system returns to the Step S100 standby state. When the system returns to the Step S100 standby state, it then advances to Step S101, and a judgment is made as to whether the temperature measured by the temperature sensor 40*c* has risen to a temperature higher than the freeze prevention temperature. If the temperature in the toilet room continues to be lower than the freeze prevention operation temperature, the system advances to Step S102, and the above described process is repeated. On the other hand if the temperature of the toilet room has risen to be higher than the freeze prevention operation temperature, the system returns to Step S100, and the judgment made in Step S101 is repeated.

The freeze prevention operation is also executed after Step S102, when a manual setting is made to implement the freeze prevention operation in the flush toilet 1. This freeze prevention operation is repeated until the freeze prevention operation setting is released by user operation of a control switch (not shown). As described above, when the temperature in the toilet room stays below the freeze prevention operation temperature, and when the freeze prevention operation has been set by the user, water spouting from the jet water spouting port 16 and the rim water spouting port 18 will be executed intermittently at approximately 10 minute intervals. By this means flush water accumulated in each of the parts of the flush water toilet 1 is prevented from freezing.

In the flush toilet of the first embodiment of the present invention, flush water expelled from a jet water spouting port is pressurized by a pressurizing pump, therefore sufficient toilet flushing can be accomplished even in localities where water main supply pressure is low. Also, because rim spouting time is adjusted by a water spouting time adjustment means, flush water can be supplied in an appropriate volume. Moreover, in the flush toilet of the present embodiment the water main supply pressure is estimated based on the water replenishment time, therefore a separate sensor for measuring pressure is not required.

In the flush toilet of the present embodiment, a water spouting time adjustment means adjusts the second rim spouting time, therefore breakage of the water seal in the drain trap pipe caused by insufficient rim water spouting and overflow from the bowl portion of large volumes of flush water due to excessive rim water spouting can be prevented.

Furthermore, in the flush toilet of the present embodiment, after completion of rim spouting supply water to the holding tank is commenced after a water supply wait time, therefore the water supply pressure at the time water is supplied to the holding tank can be prevented from being affected by rim water spouting which was being executed prior to supplying water to the holding tank.

In the flush toilet of the present embodiment, the fact that the flush water in the holding tank has reached a predetermined held water volume is detected by a float switch, therefore the time required until the held water in the holding tank is restored to the predetermined held water volume can be accurately detected.

Furthermore, in the above described first embodiment of the present invention the water spouting time adjustment means adjusted the second rim spouting time based on a detected water replenishment time, but as a variant the first rim spouting time, or the first and the second rim spouting time, could also be adjusted. Also, in the above described embodiment, the replenishment time was divided into three stages, and the rim spouting time was set for each of those divisions, but the method of setting the rim spouting time could be changed as appropriate. For example, the rim spouting time could be set to be proportional to the water replenishment time.

Next, referring to FIGS. 17 through 19, we discuss a flush toilet according to a second embodiment of the present invention. The flush toilet of this embodiment differs from the above-described first embodiment with respect to points such as that the pressurizing pump operating time is adjusted in accordance with the flow rate of flush water supplied through a constant flow valve, that switching between rim water spouting and jet water spouting is accomplished using a switching valve, and that rim water spouting continues even during jet water spouting. Therefore here we shall discuss only those points about the present embodiment which differ from the first embodiment, and we will omit a discussion of points in common.

FIG. 17 is a block diagram showing the water supply system for rim water spouting and jet water spouting. FIG. 18 is a graph showing the timing at which each section operates when the flush toilet is flushed.

As show in FIG. 17, a flush toilet 100 according to the second embodiment of the present invention has a flush toilet main body 102 and a functional portion disposed at the rear of the flush toilet main body 102. A bowl portion 112, a drain trap pipe 114, a jet spouting port 116, and a rim water spouting port 118 are formed on the flush toilet main body 102.

The flush toilet 100 according to the second embodiment of the present invention is directly connected to the water main supplying flush water, and flush water is expelled from a rim water spouting port 118 by water main supply pressure. Regarding jet-spouted water, flush water held in a holding tank built into the functional portion 110 is pressurized by a pressurizing pump and expelled from a jet water spouting port 116 in a large flow rate.

Next, we discuss the constitution of the functional portion 110. As shown in FIG. 17, a constant flow valve 120, a rim spout water electromagnetic valve 122, a tank water supply electromagnetic valve 128, a rim spout water vacuum breaker 124, and a rim spout water flapper valve 126 are built into the functional portion 110 as a water supply system for rim water spouting. Furthermore, a holding tank 132, a pressurizing pump 134, a jet water spouting vacuum breaker 136, and a jet water spouting flapper valve 138 are built into the pressurizing pump 134 as a water supply system for jet water spouting. Furthermore, a rim spout water electromagnetic valve 122, a tank water supply electromagnetic valve 128, and a controller 140 serving as a flush control means for controlling the pressurizing pump 134 are built into the functional portion 110.

A constant flow valve 120 is configured so that flush water flowing in via a stopcock 142*a*, splitter hardware 142*b*, and a strainer 142, is constrained so that it is less than a predetermined flow rate. In the present embodiment, the constant flow valve 120 limits the flush water flow rate to a nominal value of 12 liters/minute, but in actuality this flow rate varies between approximately 10-15 liters per minute due to individual differences between constant flow valves 120.

Flush water passed through the constant flow valve 120 is connected to flow into a switching valve 128 via a electromagnetic valve 122. The electromagnetic valve 122 opens and closes according to a control signal from the controller 140, causing flush water into the switching valve 128 to flow or be stopped. The switching valve 128 is disposed to divide up the flush water which has passed through the electromagnetic valve 122 into a holding tank 132 side and a rim water spouting port 118 side based on a control signal from the controller 140. This switching valve 128 is configured to split up flush water in any desired proportion between the holding tank 132 and the rim water spouting port 118 according to the setting.

The rim spout water vacuum breaker 124 is disposed at the center of the rim side water supply path 118*a* which leads flush water passing through the switching valve 128 to the rim water spouting port 118, and prevents backflow of flush water from the rim water spouting port 118.

The holding tank 132 is configured to the hold flush water which is to be spouted from the jet water spouting port 116.

Furthermore, in the present embodiment the end of the tank supply path 132 connected to the switching valve 128 is disposed to form an air gap relative to the holding tank 132, and prevents the backflow of flush water into the holding tank 132. An upper end float switch 132*b* and a lower end float switch 132*c* are disposed inside the holding tank 132 for detecting the water level inside the holding tank 132.

The upper end float switch 132 turns ON when the water level in the holding tank 132 reaches a predetermined held water level; the controller 140 detects this and causes the electromagnetic valve 122 to close. In the present embodiment, the predetermined held water level for the holding tank 132 corresponds to the predetermined held water volume and measured held water volume.

The lower end float switch 132*c* is disposed in the vicinity of the bottom surface of the holding tank 132, and turns ON when the water level in the holding tank 132 drops below that lower end float switch 1326 it is configured to detect that the holding tank 132 has become empty.

The pressurizing pump 134 is constituted to pressurize flush water held in the holding tank 132 and cause it to be expelled from the jet water spouting port 116.

The jet water spouting vacuum breaker 136 is connected to the downstream side of the pressurizing pump 134, and prevents backflow of water accumulated in the bowl portion 112 into the holding tank 132 side, as well as forming a partition between those elements. Flush water which has passed through the jet water spouting vacuum breaker 136 is expelled from the jet water spouting port 116 via the jet-side water supply path 116*a*.

The jet water spouting flapper valve 138 is connected between the holding tank 132 and the pressurizing pump 134; when the water level in the holding tank 132 falls, the flush water in the pressurizing pump 132 flows back to the holding tank 132, and the flush water inside the pressurizing pump 134 is prevented from coming out.

The controller 140 serving as the flush control means is configured so that the electromagnetic valve 122, the switching valve 128, and the pressurizing pump 134 are operated in sequence by user operation of a toilet flushing switch (not shown) to commence the spouting of water from the rim water spouting port 118 and the jet water spouting port 116 in sequence, thereby flushing the bowl portion 112. In addition, after the jet spouting has terminated flush water is replenished to the holding tank 132 by switching the switching valve 128, and when the float switch 132*b* detects the predetermined held water volume, it closes the electromagnetic valve 122 and stops the supply of water. Therefore the electromagnetic valve 122 and the switching valve 128 operate as a flush water replenishment means.

The controller 140 has built into it a clock means 140*a* for measuring the time after replenishment of flush water to the holding tank 132 commences until a predetermined holding water level is detected. Furthermore, built into the controller 140 is a water spouting volume adjustment means 140*b* for adjusting the volume of flush water spouted from the rim water spouting port 118 and the volume of flush water spouted from the jet water spouting port 116. Specifically, the controller 140 has a CPU, a memory, and an operating program.

Next, referring to FIGS. 17 and 18, we discuss the action of the flush toilet 100 according to the second embodiment of the present invention.

First, in the standby state, the first rim water spouting commences when the toilet flushing switch (not shown) is operated. In other words, at time t1 in FIG. 18, when the user operates the toilet flushing switch (not shown) the controller 140 sends a signal to the switching valve 128, and the switching valve 128 which had been switched over to the rim spouting side is temporarily switched to the tank side. Next, at time t2 the controller 140 sends a signal to the electromagnetic valve 122, releasing it so that flush water is caused to flow into the electromagnetic valve 128. By this means air which had been accumulating in the conduit 119 on the upstream side of the switching valve 128 is exhausted via the tank water supply path 132*a*. By thus exhausting air which had been accumulating in the conduit 119, the unpleasant air evacuation sound which arises when air in the conduit 119 is exhausted through the rim water spouting port 118 can be prevented.

Next, at time t3 the controller 140 sends a signal to the switchover valve 128 switching the switching valve 128, which had been temporarily switch to the tank side over to the rim water spouting side. In other words, flush water supplied from the water main flows into the constant flow valve 120 via the stopcock 142*a*, the splitter hardware 142*b*, and the strainer 142*c*. The flow rate of the flush water is limited to a predetermined flow rate by the constant flow valve 120 as it flows through that valve. Flush water that has passed through the constant flow valve 120 passes through the electromagnetic valve 122, the switching valve 128, the rim spout water vacuum breaker 124, and the rim spout water flapper valve 126, and is expelled from the rim water spouting port 118. Flush water expelled from the rim water spouting port 118 flows downward as it swirls within the bowl portion 112, and the interior wall of the bowl portion 112 is cleaned.

At time t5, after the elapse of the predetermined time period, jet water spouting is commenced. That is, at time t5 the controller 140 sends a signal to the pressurizing pump 134 causing it to start. Note that the time t5 at which jet water spouting commences is adjusted by the water spout volume adjustment means built in to the controller 140, as discussed below. As shown in FIG. 18, in the present embodiment the electromagnetic valve 122 is open even during jet water spouting, And because the switching valve 128 remains switched over to the rim water spouting side, water spouting from the rim water spouting port 118 is continued in parallel with jet water spouting. When the pressurizing pump 134 is turned on, flush water which had accumulated in the holding tank 132 is pressurized. Flush water pressurized by the pressurizing pump 134 passes through the jet-side water supply path 116*a* and is expelled from the jet water spouting port 116 opened at the bottom portion of the bowl portion 112.

More specifically, the rpm of the pressurizing pump 134 which was turned on a time t5 rises to 1000 rpm by time t6, and this rpm is maintained until time t7. By thus holding down the pressurizing pump 134 rpms immediately after start-up to a relatively low rotational speed, air which had accumulated in the vicinity of the peak portion 144 of the flush water conduit 134*a* is rapidly exhausted from the jet water spouting port 116, in the occurrence of an unpleasant air evacuation sound can be prevented.

Next, at time t7 the controller causes the rpm of the pressurizing off 134 to rise increasing the rpms up to 3500 rpm by the time t8. This rpm is maintained during his siphon start-up zone from time t8 until time t9. by causing the pressure in pump 134 rpm to rise, flush water in the holding tank 132 is expelled from the jet water spouting port 116 at a large flow rate. This causes the drain trap pipe 114 to fill up rapidly, such that the site in effect quickly starts.

Furthermore, at time t9 the controller 140 reduces the pressurizing pump 134 rpms, which drop down to 2600 rpm. This rpm is maintained from time t9 for a predetermined period of time, which is the siphon continuation zone. By thus reducing the rpm of the pressurizing pump 134, the flow rate expelled from the jet water spouting port 116 is also reduced. However the flow rate expelled from the jet water spouting port 116 in the siphon continuation zone is a sufficient flow rate to maintain the siphon action which arose in the siphon start-up zone, therefore the siphon action is continued virtually until the siphon continuation zone ends. By thus continuing the siphon effect while reducing the flow about them in the siphon continuation zone, the siphon action can be continued for a long time while keeping the volume of flush water expelled from the jet water spouting port 116 to a low level.

Since the water accumulated in the bowl portion 112 is almost completely drained by the end of the siphon continuation period, the flow rate of flush water flowing into the drain trap pipe 114 diminishes, and the siphon effect ends. The controller 140 next again causes the pressurizing pump 134 rpm to rise; vacuum is raised to 3500 rpm by time t10. this rpm is maintained during the blow zone from time t10 to time t11.

Here, with low volume of flush water expelled from the jet water spouting port in the blow zone is the same as in the siphon start-up zone, but because there is almost no accumulated water remaining in the bowl portion 112 in the blow zone, the flow rate of flush water flowing into the drain trap pipe 114 is relatively small, and the siphon effect is not restarted. In the blow zone, waste remaining in the old portion 112 or the waste trap pipe 114 is pushed out to the drain pipe D by the flush water from the jet water spouting port 116. Note that the blow zone ending time t11 is adjusted by the spout water volume adjustment means 140*b* built into the controller 140, as discussed below.

The water level in the holding tank 132 drops due to jet water spouting, but in normal use it does not drop to the water level at which the lower end float switch 132*c* turns ON. If the water level in the holding tank 132 drops abnormally due to some problem such that the lower end float switch 132*c* turns ON, the controller 140 performs an emergency shut off of the pressurizing pump 134 to prevent damage to the pressurizing pump 134.

Next, at time t11, the controller 140 reduces the pressurizing pump 134 rpm, and the pressure pump 134 stops by time t12. Rim water spouting continues after the jet water spouting has ended, so the accumulated water level in the bowl portion 112 rises. At time t13 the controller 140 sends a signal to the switching valve 128, and the switching valve 128, which had been switched to the rim water spouting side, is now switched to the tank water supply side. The switching valve 128 is completely switched over to the tank water supply side by time t14, after which all supplied flush water flows into the holding tank 132. Note that the post rim flush time, which is the time from t11 when the jet water spouting ends to the time t13 when a signal is sent to the switching valve 128, is adjusted by the water spouting volume adjustment means 140*b* built into the controller as discussed below.

At time t13, the clock means 148*a* built into the controller 140 begins measuring the water replenishment time. The inflow of flush water to the holding tank 132 causes the water level in the holding tank 132 to rise, and at time t15 the water level rises to the predetermined water level and the upper end float switch 132 turns ON. When the upper end float switch 132 turns ON, the controller 140 sends a signal to the electromagnetic valve 122 causing it to close. The clock means 140*a* measures the water replenishment time after supply water to the tank begins, up until the water level in the holding tank 132 reaches the predetermined water level and the flush water in the holding tank 132 is at the predetermined measured water volume. The water spouting volume adjustment means 140*b* built into the controller 140 adjusts the jet water spouting volume expelled from the jet water spouting port 116 and the rim spouting time over which water is expelled from the rim water spouting port 118 by varying the blow zone time and the post rim flush time based on the water replenishment time measured by the clock means 140*a*, as discussed below. After the electromagnetic valve 122 has been closed, the controller 140 sends a signal to the switching valve 128, switching the switching valve 128 from the tank water supply side to which it had been switched over to the rim water spouting side, thus returning it to the standby state at time t16.

Next, referring to FIG. 19, we discuss the adjustment of the spout water volume by the water spouting volume adjustment means 140*b* built into the controller 140. FIG. 19 is a flow chart showing the spout water volume adjustment means. Note that adjustment of the spout water volume in the present embodiment is executed primarily for the purpose of preventing an insufficiency of flush water or wasted use of flush water due to variations in flow rate between individual constant flow valves 120.

First, in the Step S0 standby state, when the toilet flushing switch (not shown) is operated towards the small flush side, the controller 140 outputs a small flush signal to the electromagnetic valve 122 or the like (Step S1). Note that adjustment of the spout water volume by the water spouting volume adjustment means 140*b* is particularly effective in the small flush case when the total volume of flush water expelled is low, and in the present embodiment adjustment of the water spouting volume is performed only for small flushes. The issuing of a small flush signal from the controller 140 results in the execution of a toilet flush as described above in Step S2. Note that the volume of flush water spouted at this time is determined by the water spouting volume adjustment means 140*b* based on the previous flush.

Here, the default value for the volume of water spouted during flushing is set to be the optimal value for the case in which the constant flow valve 120 passes exactly the designed value of flow rate under normal water pressure. This default value is not changed when water is run through the valve, such as during factory testing or the like. Moreover, when the flush toilet 100 is installed on site and the first small flush is performed in trial use, flushing is executed according to the default value, and the subsequent water replenishment time is referred to for water spouting volume adjustments.

Next, in Step S3, the switching valve 128 is switched over to the holding tank 132 side (time t13 in FIG. 18). When the switching valve 128 is switched over to the holding tank 132 side, the timer built into the controller 140 begins summing time in Step S4. That is, the clock means 140*a* begins measuring the water replenishment time. Here, during the period from time t13 to time t14, switching valve 128 is in a transitional state of being switched, so the flush water flows into both the holding tank 132 and the bowl portion 112. However, because the switching about 128 operation is reproducible, individual differences between constant flow valves 120 can be evaluated by measuring the water replenishment time after time t13.

Next, in Step S5, a determination is made as to whether the upper end float switch 132 is ON or not, and processing continues until it turns ON. Note that if the time measured by the clock means 140 exceeds a predetermined time there is a possibility the water will be turned off or stopcock 142*a* will be closed, therefore this step is forcibly terminated. In this case time measured by the clock means 140*a* is not used for adjustment of the water spouting volume.

When the water level in the holding tank 132 rises and the upper end float switch 132 turns ON, the system advances to Step S6, where the electromagnetic valve 122 is closed (time t15 in FIG. 18). Next, in Step S7, the count by the timer which had begun to accumulate in Step S4 is stopped, and the water accumulation time for the current flush is ascertained. If the constant flow valve 120 is passing a flow rate which is essentially its nominal value, this water replenishment time will be essentially the designed value time. The water replenishment time will be shorter if the flow rate passed by the constant flow valve 120 is more than the nominal value, and will be longer if the flow rate is less than the nominal value, or if the flush toilet 100 is installed in a low water pressure locality. Next, in Step S8, a calculation is made of the moving average of the water replenishment time measured on this occasion and in the past. In the present embodiment, the water replenishment times for the most recent 50 iterations, including the most recently measured water replenishment time, are averaged. Note that if there have not been 50 measured water replenishment times, all of the past water replenishment times are averaged.

Next, in Step S9, the water spouting volume for the next small flush is determined based on the moving average value of water replenishment times. That is, in the present embodiment, moving average values are divided into three categories, and one of three flushing modes appropriate to each of those is selected. When the calculated moving average value is essentially the design value, which is to say when the constant flow valve 120 has a nominal flow rate of approximately 11-13 liters/minute, the pre rim flush time (interval t4-t5 in FIG. 18) is set to approximately 4.5 seconds, the jet water spouting blow zone (interval t10-t11 in FIG. 18) is set to approximately 0.94 seconds, and the post rim flush time (interval t11-t13 in FIG. 18) is set to approximately 3.2 seconds. This results in a spouting of approximately 0.9 liters during the pre rim flush time, approximately 1.0 liters during the blow zone, and approximately 0.65 liters during the post rim flush time, such that approximately 4.5 liters of flush water are used during the entire toilet flushing.

When the moving average value is longer than the design value, i.e. at a constant flow valve 120 flow rate of less than the nominal value of approximately 11 liters/minute, the pre rim flush time, the blow zone, and the post rim flush time are set at approximately 4.8 seconds, approximately 0.99 seconds, and approximately 3.9 seconds, respectively. This results in a flush water spouting volume of approximately 0.8 liters, approximately 1.1 liters, and approximately 0.65 liters in each respective period, so that in the overall toilet flush approximately 4.4 liters of flush water are used.

Furthermore, when the moving average is shorter than the design value, i.e. when the constant flow valve 120 has a flow rate of greater than approximately 13 liters/minute, which is above the nominal value, the pre rim flush time, the blow zone, and the post rim flush time are set at approximately 4.2 seconds, approximately 0.90 seconds, and approximately 2.6 seconds, respectively. This results in a flush water spouting volume of approximately 1.05 liters, approximately 1.0 liters, and approximately 0.65 liters in each respective period, so that in the overall toilet flush approximately 4.8 liters of flush water are used.

When the next flushing mode is selected in Step S9, a single processing iteration shown in FIG. 19 is completed, and the system returns to the Step S0 standby state.

The flush toilet of the second embodiment of the present invention varies the rim spouting volume and the jet spouting volume, enabling the supply of an appropriate volume of flush water at all times even when there are large individual variations between constant flow valves, while maintaining the flushing capability of the toilet.

In the flush toilet of the present embodiment, use of the switching value enables the supply of water to the holding tank to be commenced in parallel with post rim flushing, so that the water supply time to the tank after the post rim flushing has completed can be reduced. Moreover, the time until the drain trap pipe is sealed, and the tank supply completion time, can be appropriately set by an appropriate allocation of flush water by the switching valve.

In the above-described second embodiment of the present invention, the water replenishment time was measured by measuring the predetermined held water volume at which the holding tank is full as the measured held water volume, but the measured held water volume can also be set to be lower than the predetermined held water volume. In such cases a third sensor for detecting the measured held water volume is provided between the upper end float switch and the lower end float switch, and the volume of spout water is adjusted using the time after water supply to the tank is commenced until the third sensor detects the measured held water volume as the water replenishment time. In addition, in the embodiment described above the held water volume was measured using a float switch, but the held water volume can also be measured using any optional sensor, such as a pressure sensor disposed within the holding tank, or the like.

In the present embodiment the rim spout water volume and the jet spout water volume were adjusted in accordance with the water replenishment time, but a flush toilet could also be constituted to adjust only one of those.

That is, a flush toilet could also be constituted so that only the pre rim flush time and the post rim flush time are adjusted. For example, with a constant flow valve flow rate equal to a nominal value of approximately 11-13 liters/minute, the pre rim flush time would be set to approximately 4.5 seconds, the blow zone to approximately 0.94 seconds, and the post rim flush time to approximately 3.2 seconds, with the flush water volume in each time period being approximately 0.9 liters, approximate 1.0 liters, at approximately 0.65 liters respectively, and the overall toilet flush being approximately 4.5 liters. If the constant flow valve has a flow rate of less than approximately 11 liters/minute, the respective flush times would be approximately 5.4 seconds, approximately 0.94 seconds, and approximately 3.9 seconds, and the flush water volume in each period would be approximately 0.9 liters, approximately 1.0 liters, and approximately 0.65 liters, for an overall toilet flush of approximately 4.4 liters. If a constant flow valve has a flow rate of less than approximately 13 liters/minute, the respective flush times would be approximately 4.2 seconds, approximately 0.94 seconds, and approximately 2.6 seconds, and the flush water volume in each period would be approximately 1.05 liters, approximately 1.0 liters, and approximately 0.65 liters, for an overall toilet flush of approximately 4.8 liters.

By distributing the water spouting volume in the pre rim flush, the jet water spouting, and the rear water spouting to match the actual flow rate of the constant flow valve, wastage of flush water can be prevented without a reduction in flush capability. The present inventors have also discovered the following actions and effects in the water spoutings occurring in each period. That is, in the pre rim flush spouting there is an effect whereby waste adhering to the surface of the bowl portion is caused to fall into the accumulated water in the bowl portion. In particular, in flush toilets in which the bowl portion is flushed by a swirling flow as in the present embodiment, toilet paper, floating waste, and the like can be collected in the center of accumulated water by the water spouting coming from the pre rim flush. This enables the effective discharge of floating waste and the like into the drain trap when a siphon action is generated. Also, the accumulated water level in the bowl portion rises due to the spouting of water in the pre rim flush, such that water head pressure increases and the flush water is forced into the drain trap pipe, facilitating an early start of the siphon effect.

On the other hand, water spouting in the post rim flush requires a water spout volume capable of reliably sealing the drain trap pipe. For this reason, if the flow rate of the constant flow valve is low, there is a risk that the seal will break unless the post rim flush is made longer than for the case in which the constant flow valve operates per the design value. Conversely, if the flow rate of the constant flow valve is high, water wastage occurs unless the post rim flush is made shorter than for the case in which the constant flow valve operates per the design value.

Jet water spouting is done primarily to start a siphon action, causing the flush water and waste in the bowl portion to be discharged, but during jet water spouting in the blow zone (times t10-t11 in FIG. 18) there is an effect whereby floating waste and the like trying to return to the bowl portion from midway along the drain trap pipe pass over the highest portion of the drain trap pipe and are dropped into the down pipe.

Note that in the present embodiment described above, the pressurizing pump rpm in the siphon start-up region (times t8-t9 in FIG. 18) was 3500 rpm, 2600 rpm in the siphon continuation region (time t9-t10 in FIG. 18), and 3500 rpm in the blow zone, but these rpms and the duration of each of region can be changed as appropriate. For example, the siphon start-up time can be brought further forward by increasing the siphon effect start-up region pressurizing pump rpm to approximately 3600 rpm. Also, floating waste and the like attempting to return into the bowl portion can be strongly pushed out by increasing the blow zone pressurizing pump rpm to approximately 3600 rpm, so that even if the blow zone time is shortened, one can expect a similar waste push-out effect. Alternatively, lengthening the time period without changing the blow zone rpm permits a more reliable pushing out of floating waste and the like, obtaining the most favorable results in the experiments of the inventors.

Considering these actions and effects, good results are obtained when the constant flow valve flow rate is low, as flush water required for sealing is secured when the post rim flush time is extended, whereas extending the pre flush time enables the collection of floating waste and the like in the middle of the accumulated water surface, as well as an early start of the siphon action by raising the accumulated water level. This is because in small flushes, particularly, it is more important to create a state in which waste can be discharged reliably even with a weak siphon action than to generate a strong siphon action. Regarding jet water spouting, it is effective to lengthen the blow zone, either in addition to the above changes, or independently.

On the other hand, when constant flow valve flow rate is large, the post rim flush time can be shortened to prevent water waste, and a portion of the flush water thus saved can be directed at the pre rim flush to enable reliable discharge of floating waste. With respect to jet water spouting, it is also effective, in addition to these changes, or independently thereof, to lengthen the blow zone duration.

Furthermore, in the second embodiment of the present invention described above, the spout water adjustment means adjusted the water spout volume using a moving average of the last 50 water replenishment times, but as a variant, water spouting volume could also be adjusted using another algorithm. For example, the water spouting volume for the next iteration could be determined based on a single most recent water replenishment time. This would enable the adjustment of water spouting volume in response to short-term fluctuations in the water main supply pressure.

Alternatively, the spout water volume could be adjusted based on the most recent water replenishment time and the water replenishment time previous to that. For example, if the water replenishment time were divided into approximately 5 rank stages, and the gap between the most recent water replenishment time and the water replenishment time prior to that were within approximately 2 stages, a water spouting volume based on the most recent water replenishment time could be used for the next flush. This would enable a balance to be struck between water spouting volume responsiveness and safety.

Preferred embodiments of the present invention were described above, but several variants to the embodiments described above may also be added. In particular, water spouting volumes or water spouting times determined on the basis of the most recent water replenishment time were used for the upcoming flush, but the most recent water replenishment time could also be reflected in the current toilet flush.

In one such variant, the controller could be configured so that when the water replenishment time detected in the most recent toilet flush is longer by a predetermined length of time than the previous water replenishment time, additional water spouting would be added to raise the water level in the bowl portion after the holding tank had been restored to a predetermined held water volume. That is, if the water replenishment time in the most recent toilet flush greatly exceeds the previous water replenishment time, this would mean that the post rim flush, in which flow rate was greatly reduced compared to the previous iteration, would be carried out for just the rim spouting time determined based on the previous toilet flush, when flow rate was high. Therefore in the worst case, the volume of flush water in the post rim flushing would be insufficient, such that the drain trap pipe could not be sealed. The controller would therefore perform additional water spouting to raise the bowl portion water level so that this type of flush water insufficiency would not occur.

In the present variant thus constituted, seal failure can be prevented even when there is a sudden drop in water main pressure, such as when there is simultaneous water main use for toilet flushing and bathing or the like.

Additionally, in the present variant the volume of flush water supplied to the bowl portion is calculated from the rim spout water flow rate corresponding to the most recent water replenishment time, and the post rim flush time determined based on the previous toilet flush (the most recent rim spouting time). Next, the insufficiency of flush water is obtained from the calculated flush water volume and the volume of flush water previously recorded as necessary to seal the drain trap type, and this insufficient portion of flush water is supplied to the bowl portion as additional spout water.

In the present variant thus constituted, the trap drain can be reliably sealed, and water wastage caused by excessive additional spout water volume can be prevented.

Alternatively, as in the above-described second embodiment, when the spout water flow in divided by rank into several stages and post rim flush times are set for each separate rank, an additional spout water volume could also be preset in accordance with the number of ranks in the interval between the most recent water replenishment time and the previous water replenishment time, such that a sufficient volume is preset irrespective of the insufficiency of flush water.

Moreover, additional water spouting could also be implemented through the rim spout water port by appropriately releasing spout water via an electromagnetic valve, or an electromagnetic valve and a switching valve, or by switching, or through the jet water spouting port by operating a pressurizing pump at low-speed.

Alternatively, additional water spouting could also be implemented through an overflow path (not shown) extending from within the holding tank. When the water level inside the holding tank exceeded a predetermined level, the overflow path could discharge flush water in the holding tank into the bowl portion, preventing an overflow of flush water from the holding tank. This overflow path could be configured to connect to the bowl portion via the rim water spouting port or the jet water spouting port. Or, the overflow path could be configured to connect to the bowl portion via an opening provided separately from the rim water spouting port and the jet water spouting port.

Note that when adding spout water via the overflow path, the controller continues to supply water to the holding tank after the float switch has detected that the tank is full, thereby causing the necessary volume of flush water to overflow into the bowl portion.

Figure 1:
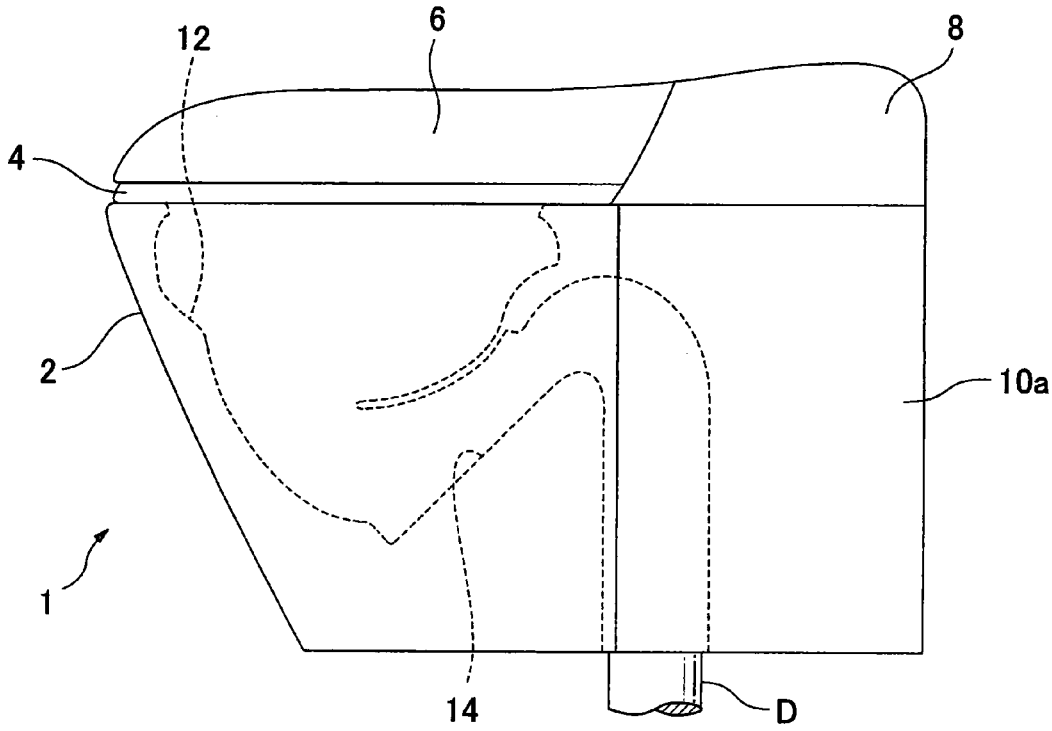
FIG. 1A right side elevation of a flush toilet according to a first embodiment of the present invention.
Figure 2:
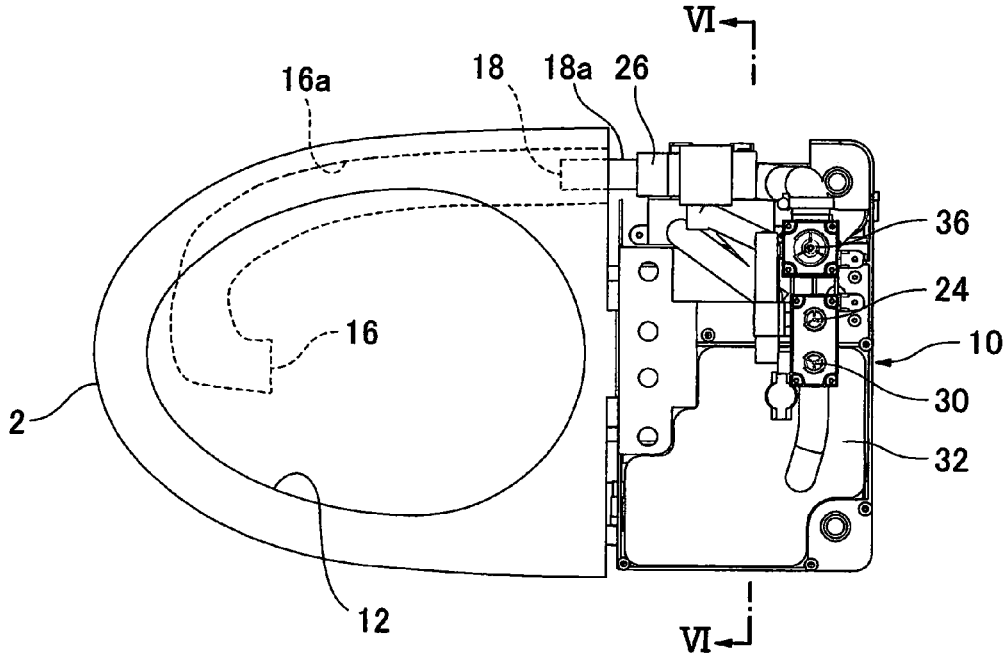
FIG. 2 A top plan view of a flush toilet according to a first embodiment of the present invention.
Figure 3:
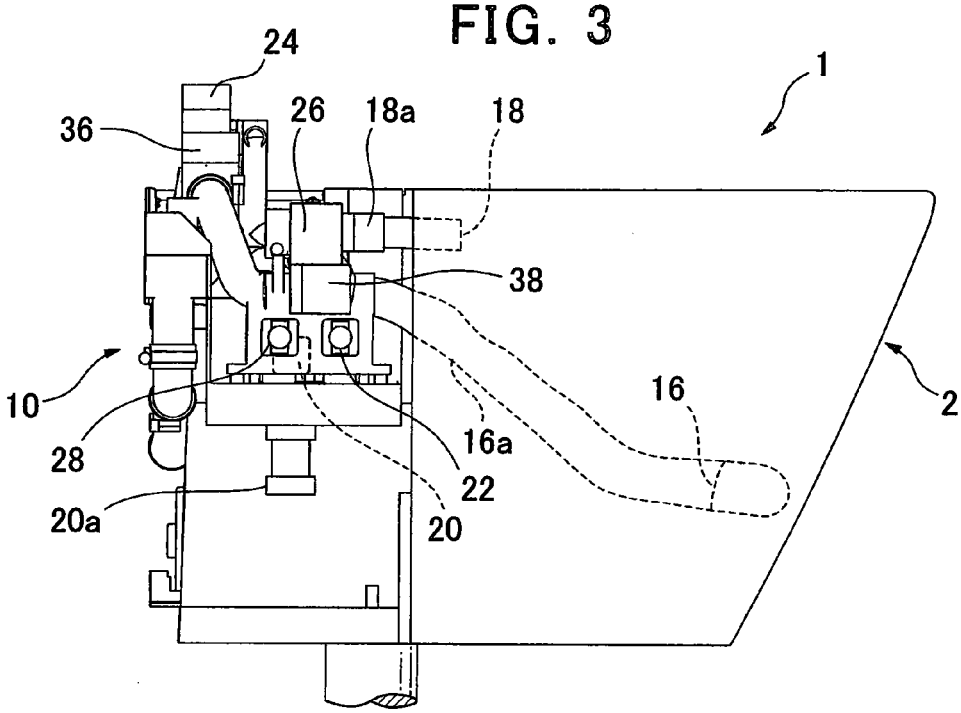
FIG. 3 A left side elevation of a flush toilet according to a first embodiment of the present invention.
Figure 4:
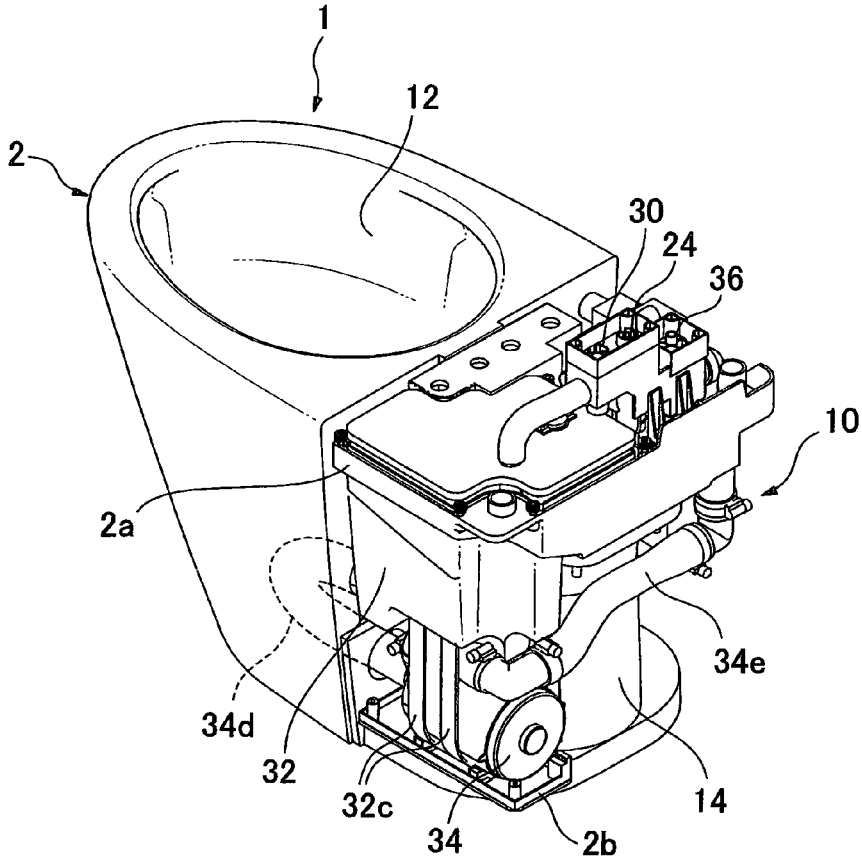
FIG. 4 A perspective view looking down diagonally from the rear right of a flush toilet according to a first embodiment of the present invention.
Figure 5:
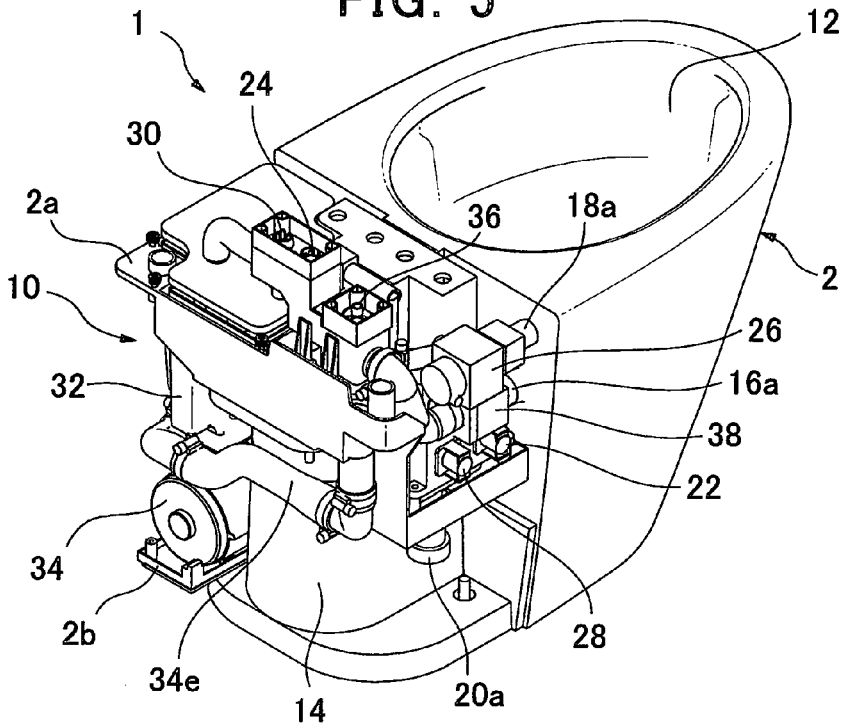
FIG. 5 A perspective view looking down diagonally from the left right of a flush toilet according to a first embodiment of the present invention.
Figure 6:
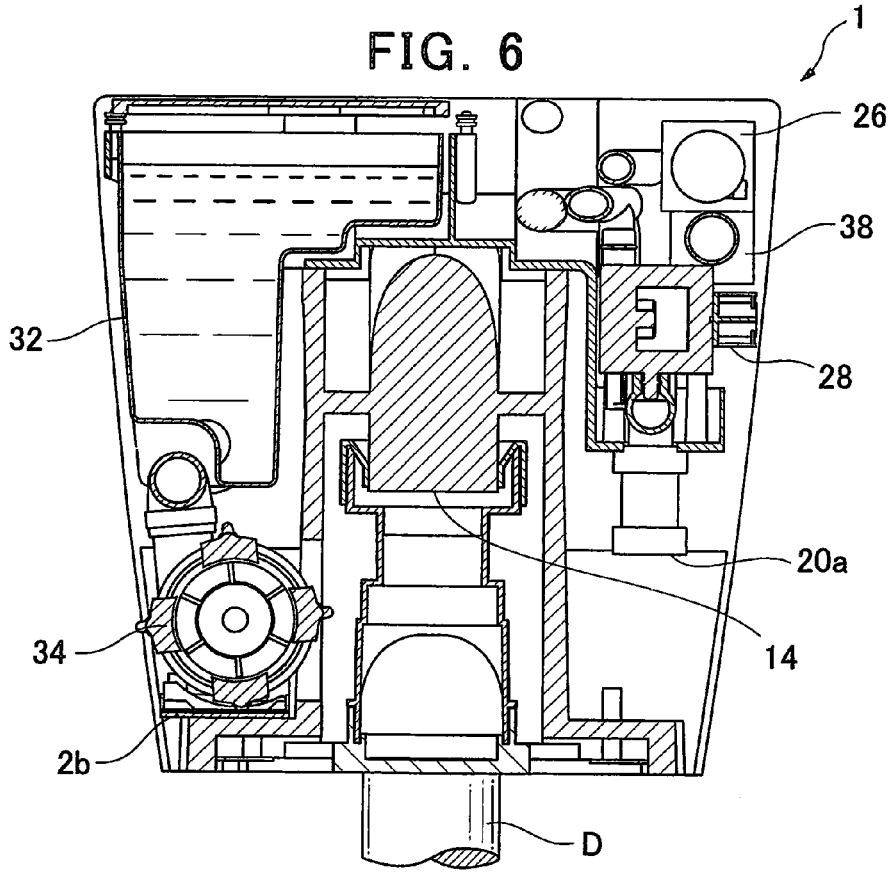
FIG. 6 A cross section along line VI-VI in FIG. 2.
Figure 7:
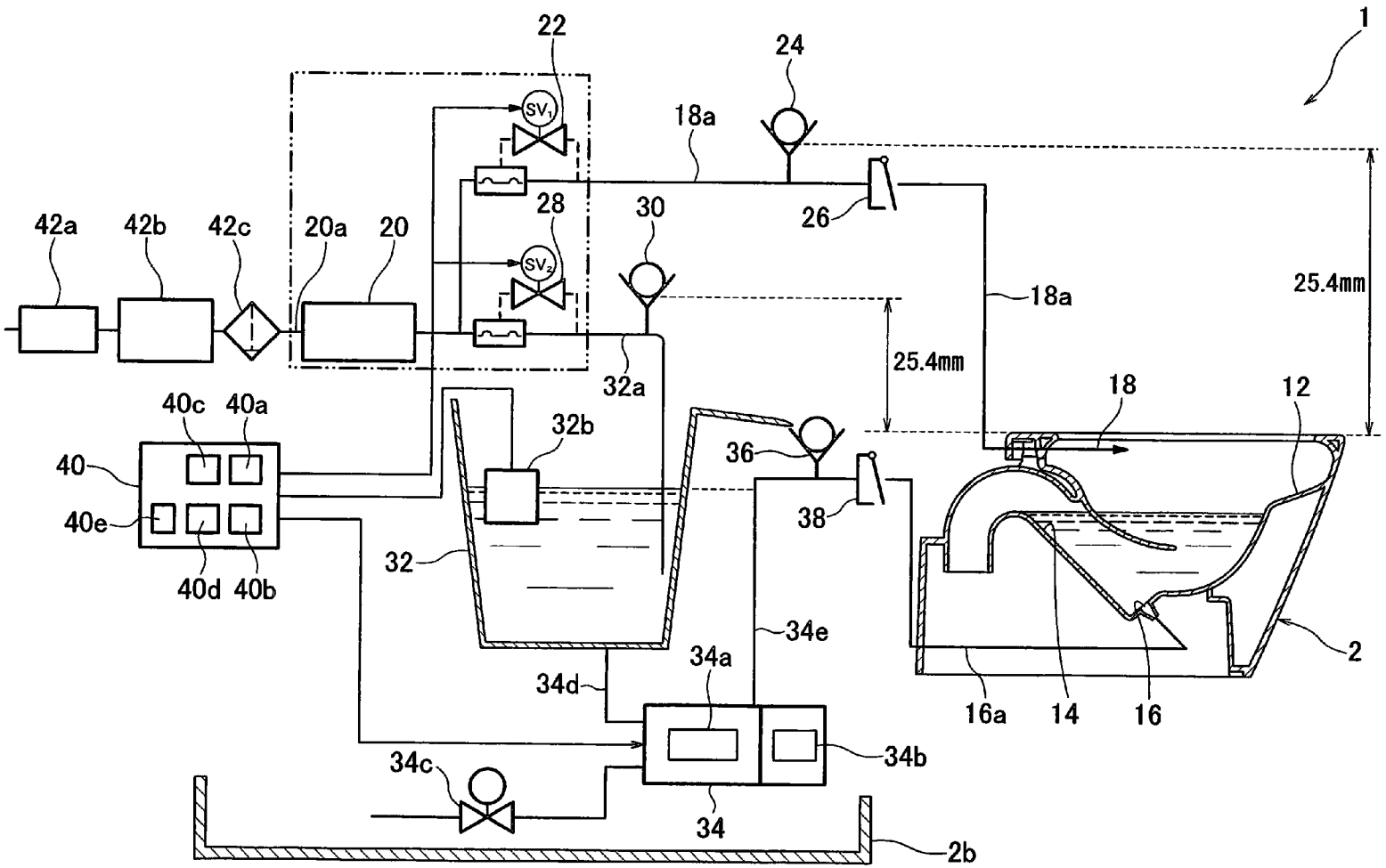
FIG. 7 A block diagram showing the water supply system for the rim water spouting and the jet water spouting.
Figure 8:
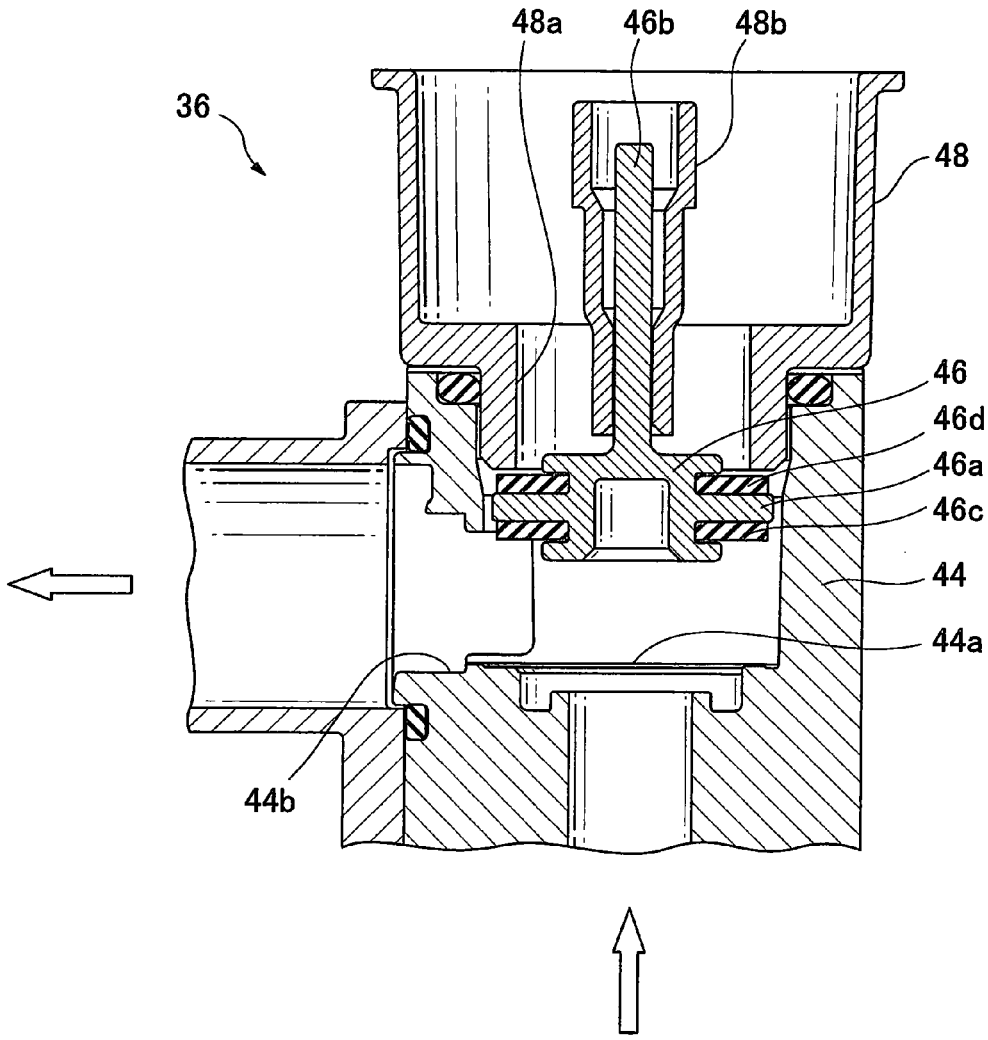
FIG. 8 A cross section of a jet water spouting vacuum breaker.
Figure 9:
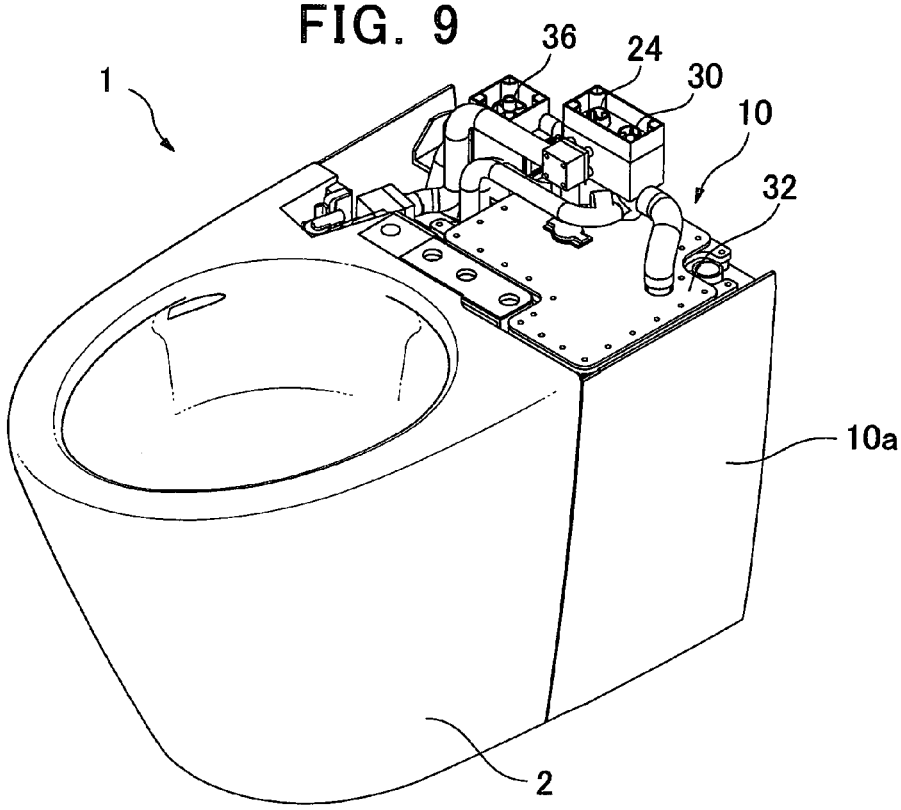
FIG. 9 A perspective view showing the procedure for removing a holding tank and a pressurizing pump.
Figure 10:
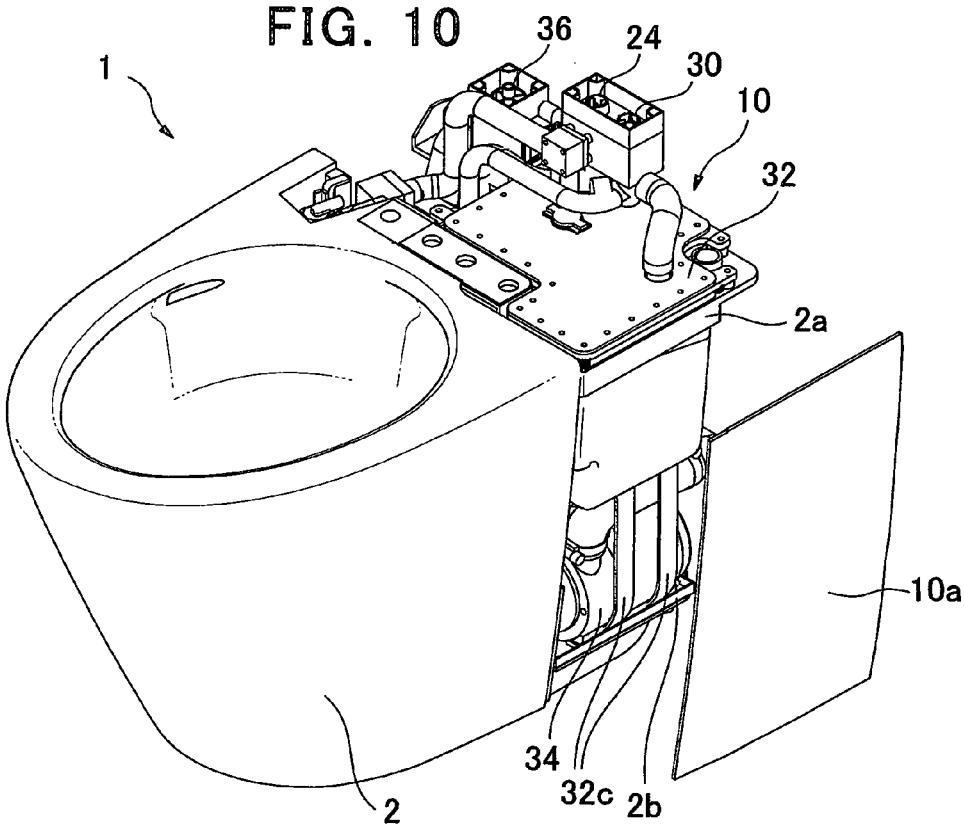
FIG. 10 A perspective view showing the procedure for removing a holding tank and a pressurizing pump.
Figure 11:
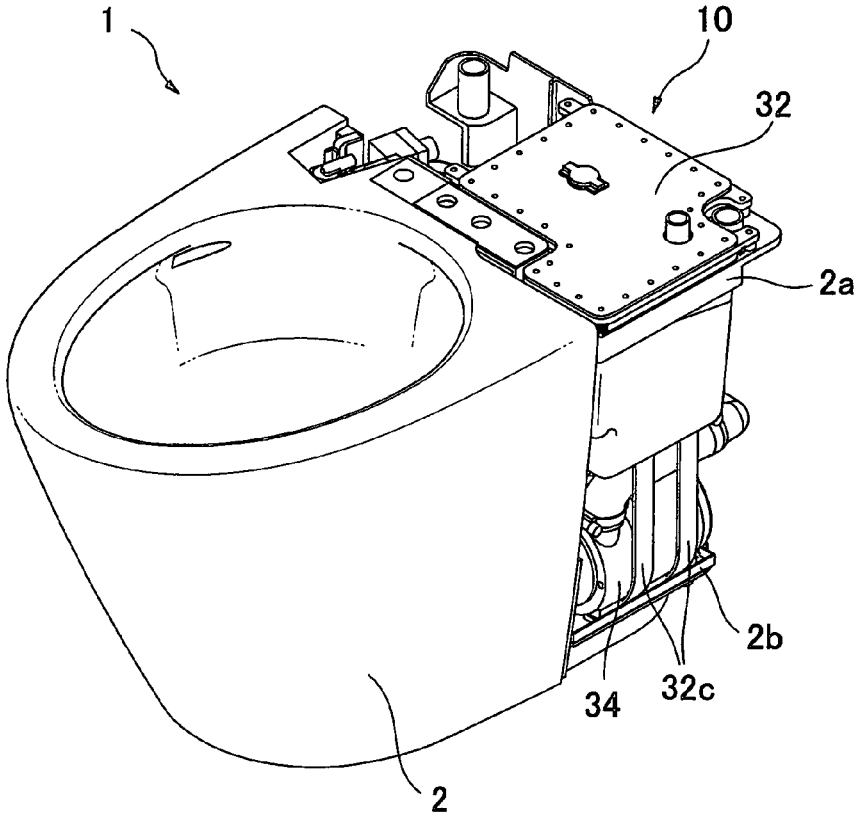
FIG. 11A perspective view showing the procedure for removing a holding tank and a pressurizing pump.
Figure 12:
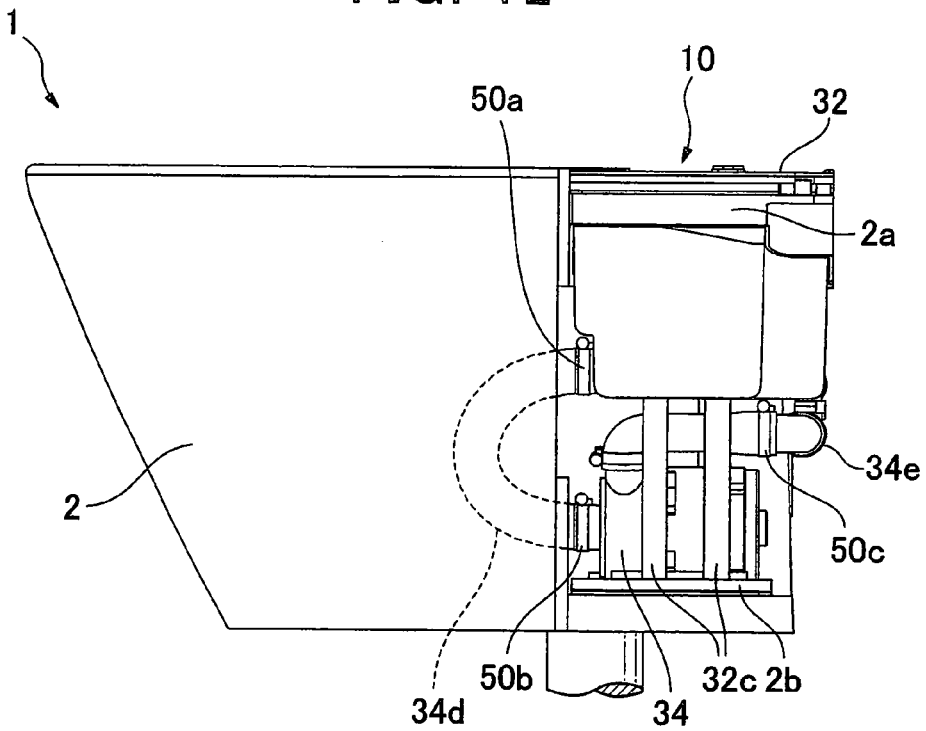
FIG. 12 A side elevation showing the procedure for removing a holding tank and a pressurizing pump.
Figure 13:
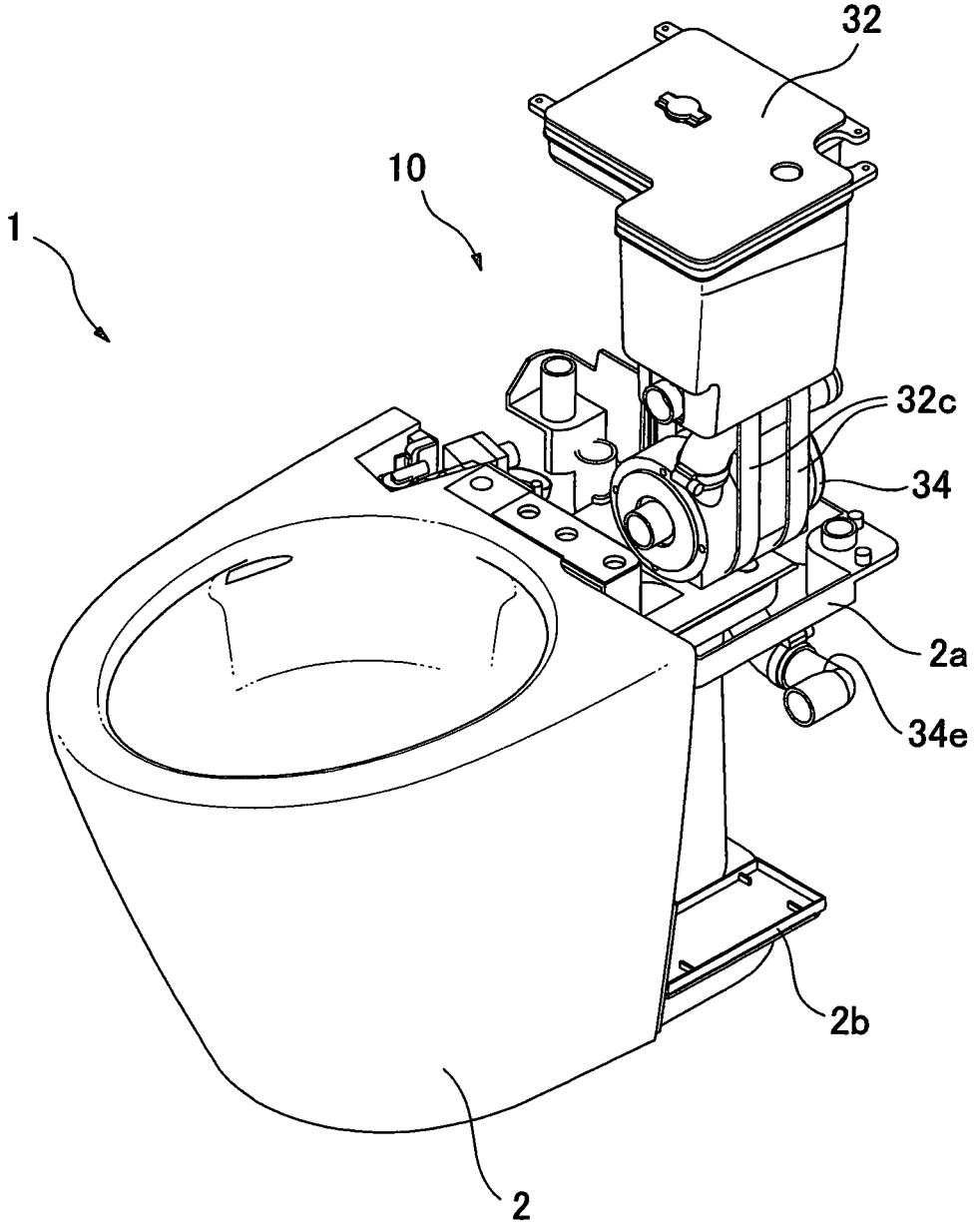
FIG. 13 A perspective view showing the procedure for removing a holding tank and a pressurizing pump.
Figure 14:
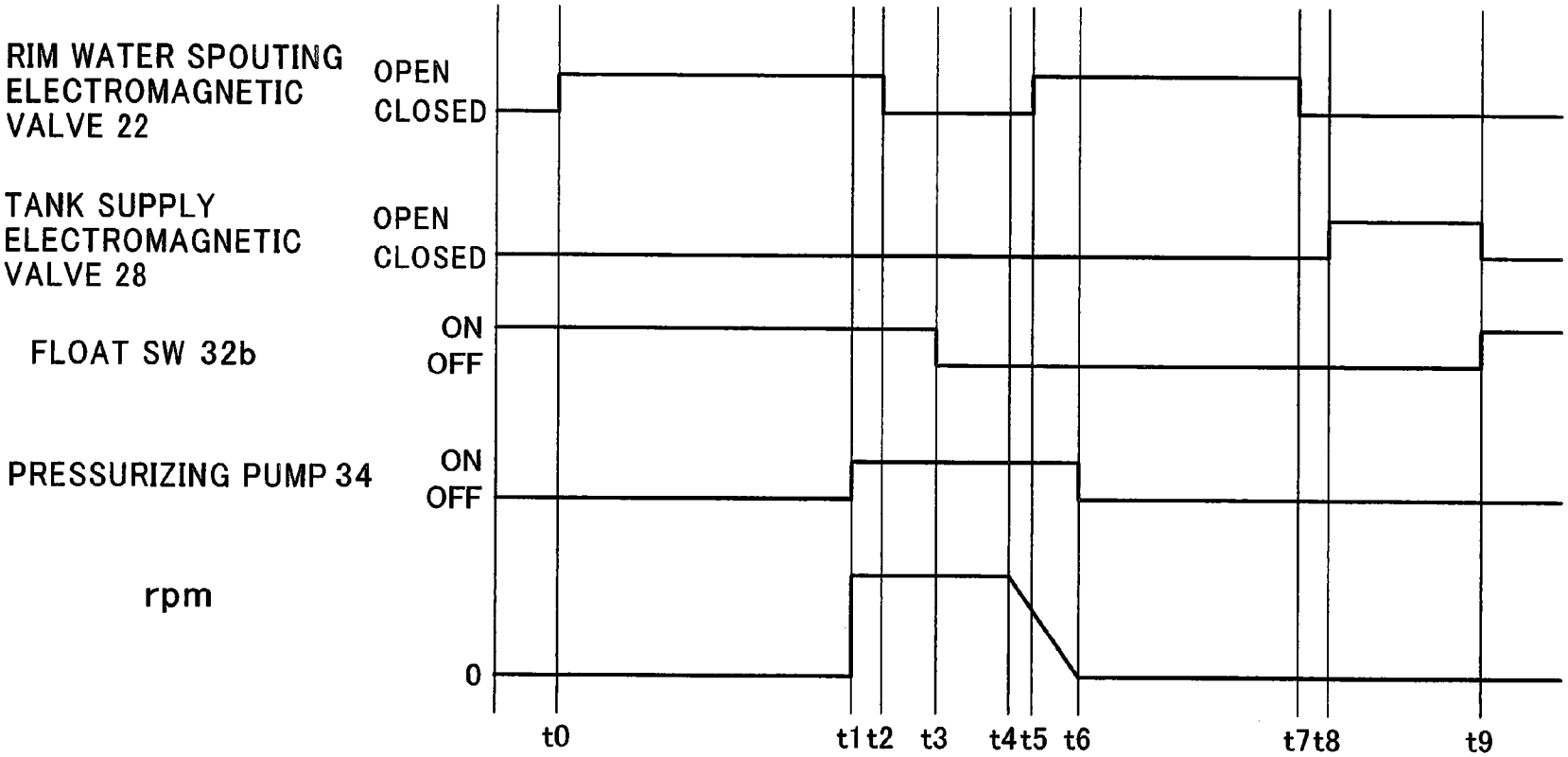
FIG. 14 A graph showing the timing at which each portion operates when flushing a flush toilet.
Figure 15:
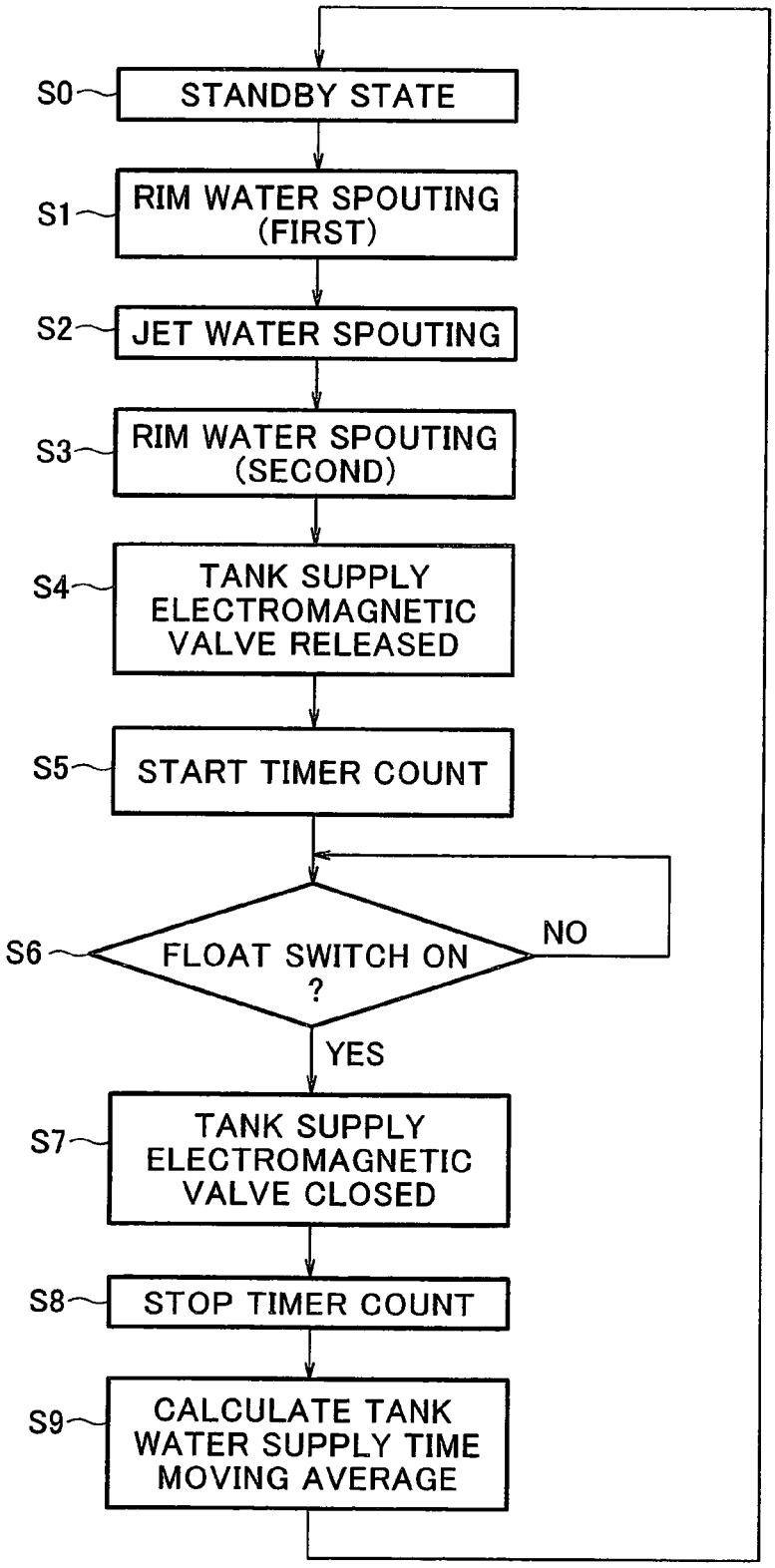
FIG. 15 A flow chart showing the flushing action in a flush toilet.
Figure 16:
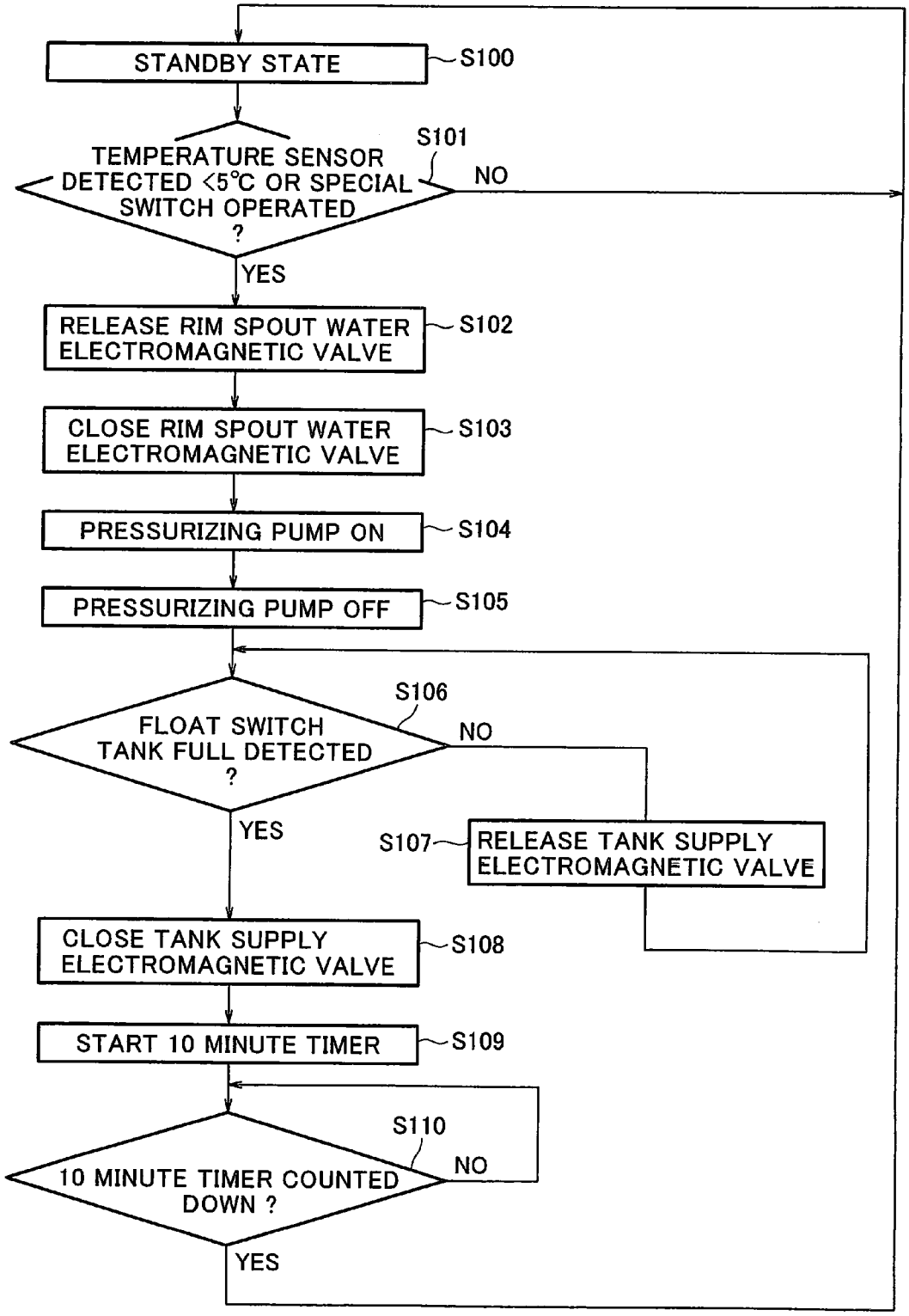
FIG. 16 A flow chart showing the freeze prevention operation in a flush toilet.
Figure 17:
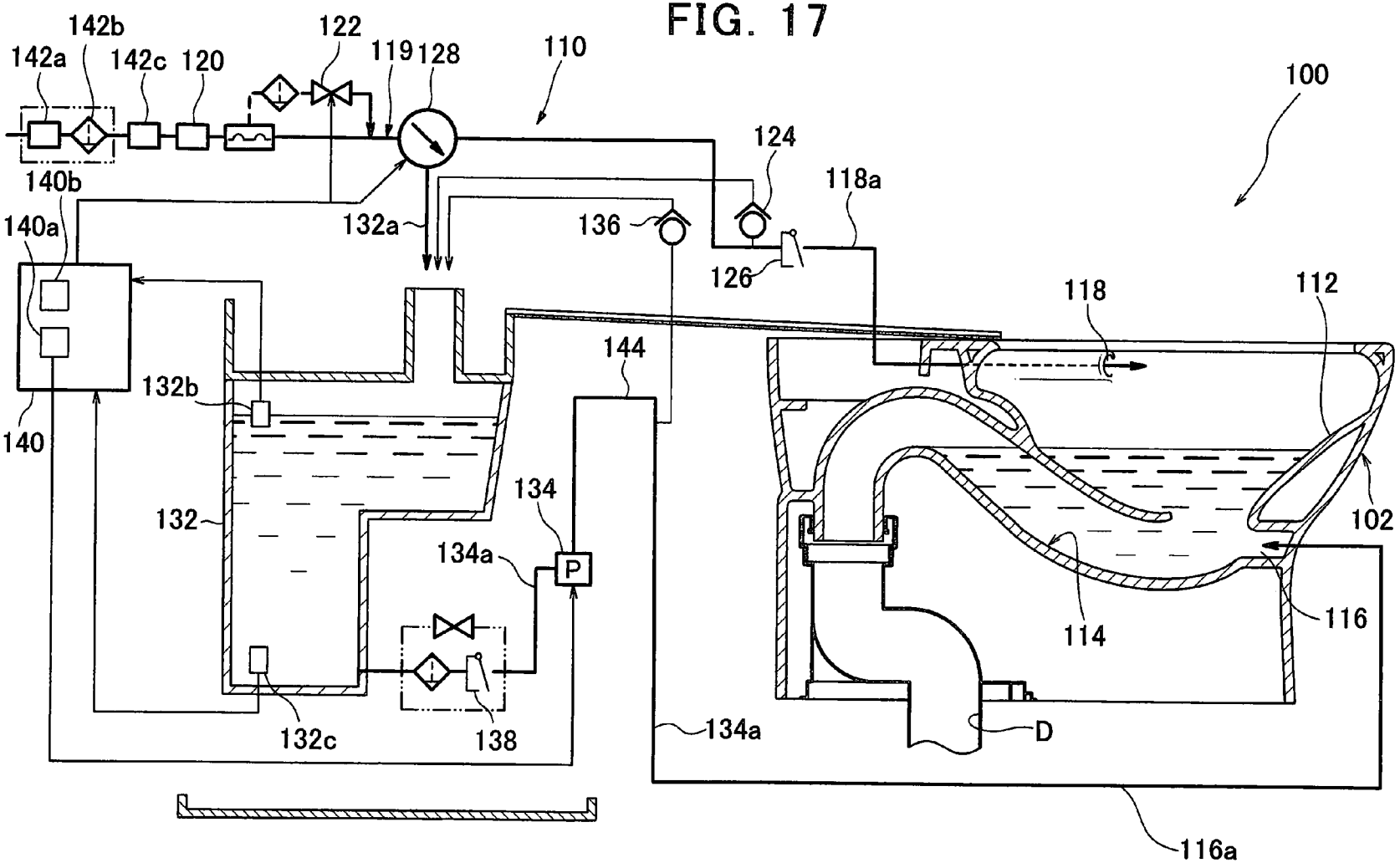
FIG. 17 A block diagram showing a rim water spouting and jet water spout water supply system in a second embodiment of the present invention.
Figure 18:
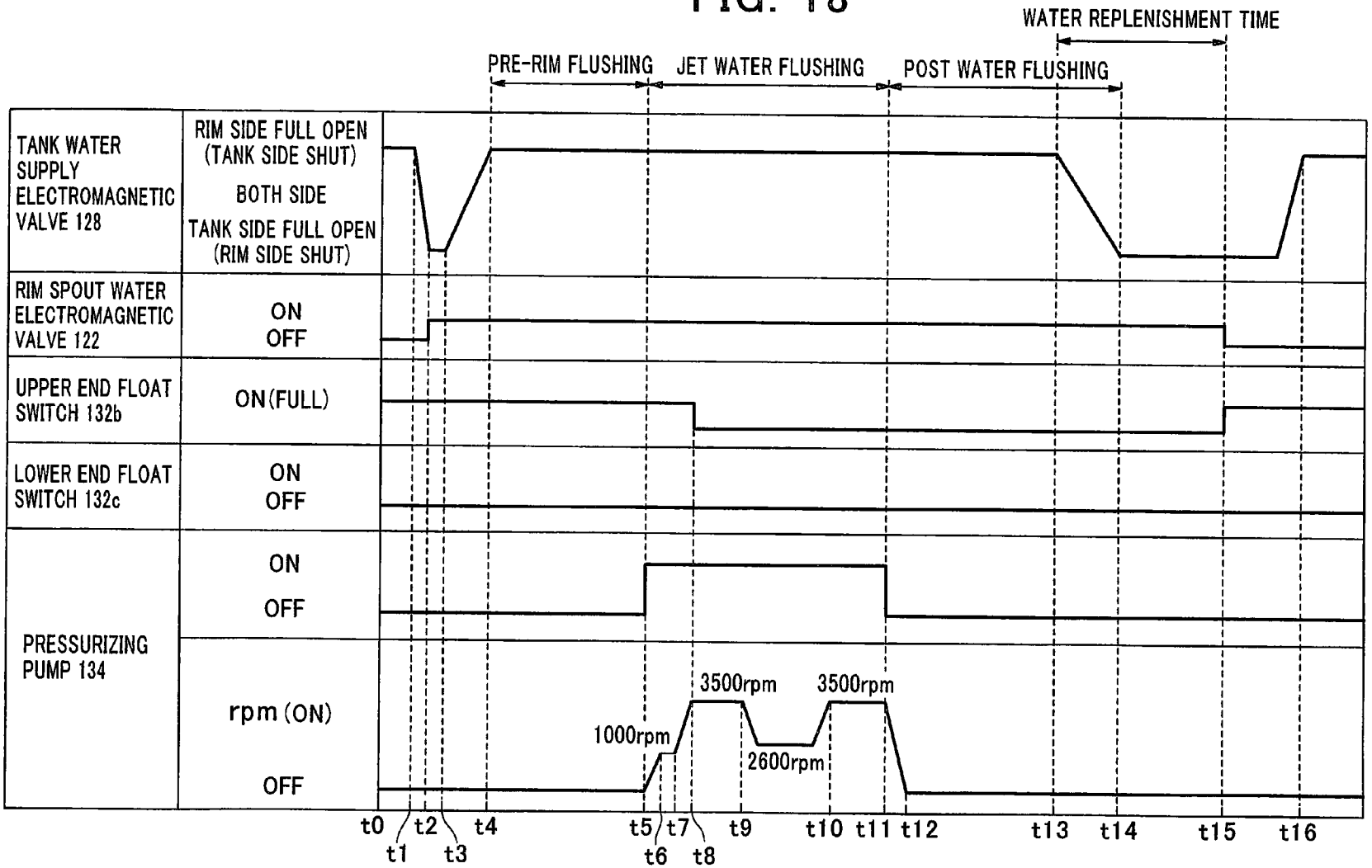
FIG. 18 A graph showing the timing at which each portion functions when a flush toilet is flushed.
Figure 19:
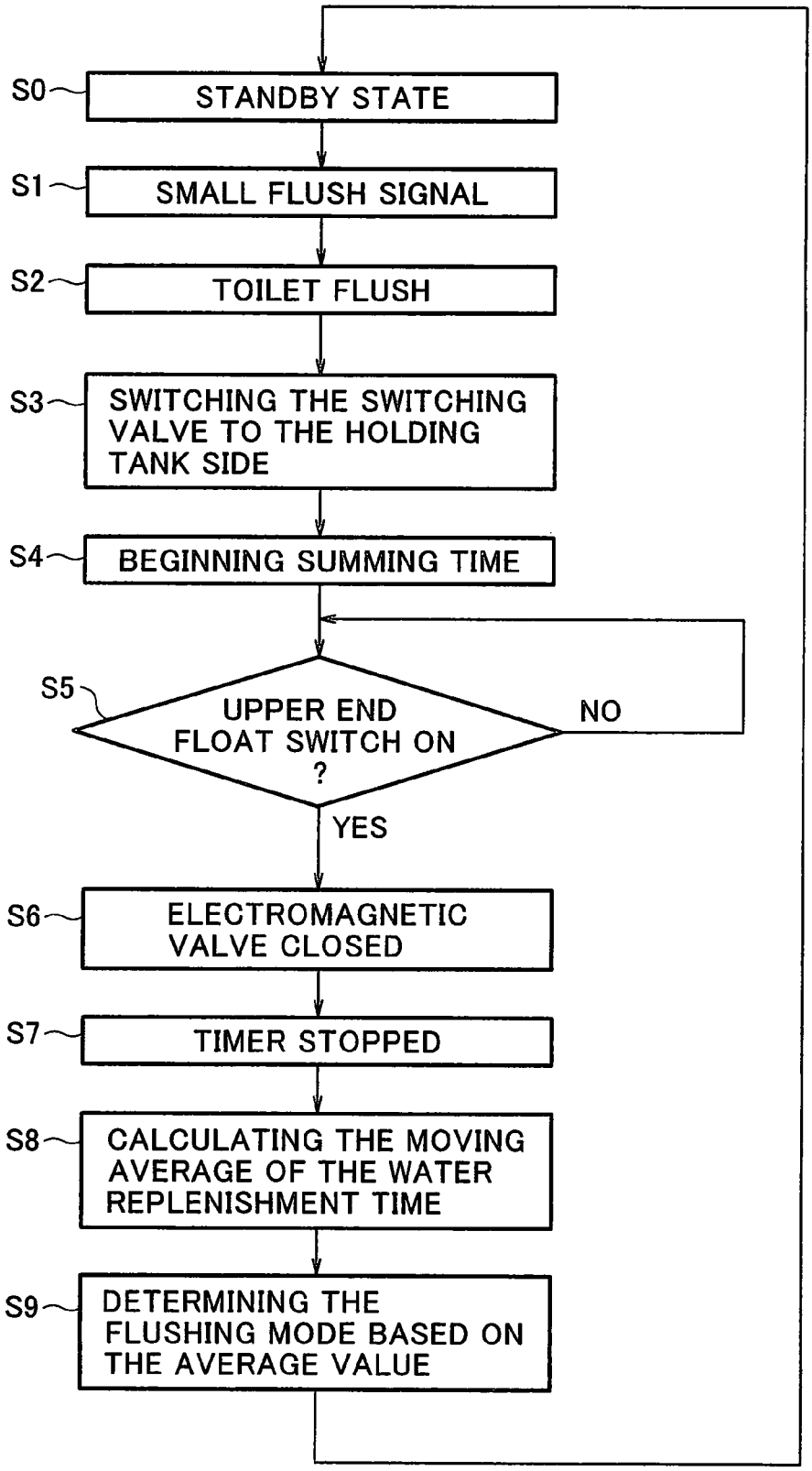
FIG. 19 A flowchart showing a procedure for adjusting flow water volume.

The invention claimed is:

1. A flush toilet flushed by pressurized flush water, comprising:

a flush toilet main body furnished with a bowl portion on which a rim water spouting port and a jet water spouting port are formed, and a drain trap pipe;

a pressurizing pump for pressurizing flush water spouted from the jet water spouting port;

a holding tank for holding flush water to be pressurized by the pressurizing pump;

flush control means for causing flush water to be spouted from the rim water spouting port for a predetermined rim spouting time using water main supply pressure, and for flushing the bowl portion by causing a predetermined jet spouting volume of flush water in the holding tank to be spouted from the jet spouting port using the pressurizing pump;

flush water replenishment means for supplying flush water from the water main to the holding tank after flushing the bowl portion, thereby restoring the volume of water held in the holding tank to a predetermined pre-flush held water volume;

clock means for detecting the water replenishment time starting from the commencement of flush water supply by the flush water replenishment means until the volume of water held in the holding tank is restored to the predetermined held water volume; and water spouting time adjustment means for adjusting the rim spouting time during which flush water is spouted from the rim water spouting port by the flush control means, based on the water replenishment time detected by the clock means.

2. The flush toilet according to claim 1, wherein the flush control means is constituted to sequentially execute a first water spouting from the rim water spouting port, a water spouting from the jet water spouting port, and a second water spouting from the rim water spouting port, and the water spouting time adjustment means adjusts the duration of the second rim water spouting from the rim water spouting port.

3. The flush toilet according to claim 1, wherein after completion of water spouting from the rim water spouting port, the flush water replenishment means commences supplying water to the holding tank after waiting a predetermined water supply wait time.

4. The flush toilet according to claim 1, further comprising a float switch for detecting the water level in the holding tank, and wherein the clock means detects the time up until the float switch detects the predetermined held water volume.

5. A flush toilet flushed by pressurized flush water, comprising:

a flush toilet main body furnished with a bowl portion on which a rim water spouting port and a jet water spouting port are formed, and a drain trap pipe;

a pressurizing pump for pressurizing flush water spouted from the jet water spouting port;

a holding tank for holding flush water to be pressurized by the pressurizing pump;

flush control means for causing flush water to be spouted from the rim water spouting port using water main supply pressure, and for causing flush water in the holding tank to be spouted from the jet spouting port using the pressurizing pump;

flush water replenishment means for supplying flush water from a water main to the holding tank after jet water spouting is completed, thereby restoring the volume of water held in the holding tank to a predetermined pre-flush held water volume;

clock means for detecting the water replenishment time starting from the commencement of flush water supply by the flush water replenishment means until the volume of water held in the holding tank is restored to a predetermined measured held water volume which is less than the predetermined held water volume; and water spouting volume adjustment means for adjusting the rim spouting time from the rim water spouting port or the jet water spouting volume spouted from the jet water spouting port, based on the water replenishment time detected by the clock means.

6. The flush toilet according to claim 5, wherein the spout water volume adjustment means adjusts the jet water spouting volume by changing the duration of the pressurizing pump operation.

7. The flush toilet according to claim 5, wherein the spout water adjustment means adjusts the jet water spouting volume by varying the rpm of the pressurizing pump.

8. The flush toilet according to claim 5, wherein jet water spouting comprises a siphon start-up zone in which siphon action is started up, a siphon continuation zone wherein flow rate is less than in the siphon start-up zone, and started-up siphon action is continued, and a blow zone for pushing out waste within the drain trap pipe after completion of the siphon action, and the flush control means operates the pressurizing pump at an rpm approximately equal to that of the siphon start-up zone.

9. The flush toilet according to claim 6, wherein jet water spouting comprises a siphon start-up zone in which siphon action is started up, a siphon continuation zone wherein flow rate is less than in the siphon start-up zone, and started-up siphon action is continued, and a blow zone for pushing out waste within the drain trap pipe after completion of the siphon action, and the flush control means operates the pressurizing pump at an rpm approximately equal to that of the siphon start-up zone.

10. The flush toilet according to claim 8, wherein the spout water volume adjustment means adjusts the jet water spouting volume by varying the blow zone time.

11. The flush toilet according to claim 9, wherein the spout water volume adjustment means adjusts the jet water spouting volume by varying the blow zone time.

12. The flush toilet according to claim 1, wherein the flush control means performs rim water spouting over a rim spouting time adjusted based on the water replenishment time detected during the previous toilet flush; in cases where the water replenishment time detected in the most recent toilet flush is longer by a predetermined time than the previous water replenishment time, the water level inside the bowl portion will be raised by additional water spouting after the holding tank is restored to the predetermined held water volume.

13. The flush toilet according to claim 5, wherein the flush control means performs rim water spouting over a rim spouting time adjusted based on the water replenishment time detected during the previous toilet flush; in cases where the water replenishment time detected in the most recent toilet flush is longer by a predetermined time than the previous water replenishment time, the water level inside the bowl portion will be raised by additional water spouting after the holding tank is restored to the predetermined held water volume.

14. The flush toilet according to claim 12, wherein the volume of flush water supplied to the bowl portion by the addition of flush water is determined by the flush control means based on the rim water spouting flow rate and the most recent rim spouting time corresponding to the most recent water replenishment time, so as to seal the drain trap pipe.

15. The flush toilet according to claim 13, wherein the volume of flush water supplied to the bowl portion by the addition of flush water is determined by the flush control means based on the rim water spouting flow rate and the most recent rim spouting time corresponding to the most recent water replenishment time, so as to seal the drain trap pipe.

16. A flush toilet flushed by pressurized flush water, comprising:

a flush toilet main body furnished with a bowl portion on which a rim water spouting port and a jet water spouting port are formed, and a drain trap pipe;

a pressurizing pump for pressurizing flush water spouted from the jet water spouting port;

a holding tank for holding flush water to be pressurized by the pressurizing pump;

flush control means for causing flush water to be spouted from the rim water spouting port using water main supply pressure, and for causing flush water in the holding tank to be spouted from the jet spouting port using the pressurizing pump;

flush water replenishment means for supplying flush water from a water main to the holding tank after jet water spouting is completed, thereby restoring the volume of water held in the holding tank to a predetermined pre-flush held water volume;

clock means for detecting the water replenishment time starting from the commencement of flush water supply by the flush water replenishment means until the volume of water held in the holding tank is restored to a predetermined measured held water volume which is less than the predetermined held water volume; and water spouting volume adjustment means for adjusting the rim spouting time from the rim water spouting port or the jet water spouting volume spouted from the jet water spouting port, based on the water replenishment time detected by the clock means; and wherein the spout water adjustment means adjusts the jet water spouting volume by varying the rpm of the pressurizing pump.

* * * * *